US007914096B2

(12) United States Patent
Hagiwara et al.

(10) Patent No.: US 7,914,096 B2
(45) **Date of Patent: *Mar. 29, 2011**

(54) IMAGE FORMING APPARATUS, LANDING POSITION SHIFT CORRECTION METHOD, AND LANDING POSITION SHIFT CORRECTION SHEET MEMBER

(75) Inventors: Takumi Hagiwara, Aichi (JP); Noboru Sawayama, Kanagawa (JP); Kenichi Kawabata, Kanagawa (JP); Mamoru Yorimoto, Tokyo (JP); Tetsuro Hirota, Kanagawa (JP); Tetsu Morino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 158 days.

This patent is subject to a terminal disclaimer.

(21) Appl. No.: 12/047,962

(22) Filed: Mar. 13, 2008

(65) Prior Publication Data

US 2008/0225098 A1 Sep. 18, 2008

(30) Foreign Application Priority Data

Mar. 17, 2007 (JP) ..... 2007-069676

(51) Int. Cl.
*B41J 29/38* (2006.01)

(52) U.S. Cl. ..... 347/14; 347/9; 347/19

(58) Field of Classification Search ..... 347/14
See application file for complete search history.

(56) References Cited

U.S. PATENT DOCUMENTS 4,644,372 A 2/1987 Hirota
4,661,822 A 4/1987 Hirota et al.
5,754,202 A 5/1998 Sekiya et al.
5,818,482 A 10/1998 Ohta et al.
5,821,953 A 10/1998 Nakano et al.
6,036,298 A * 3/2000 Walker ..... 347/19
6,053,597 A 4/2000 Hirota
6,287,027 B1 9/2001 Komiya et al.
6,331,052 B1 12/2001 Murai et al.
7,033,014 B2 * 4/2006 Ohashi et al. ..... 347/104

(Continued)

FOREIGN PATENT DOCUMENTS

JP 4-39041 2/1992

(Continued)

OTHER PUBLICATIONS

Dec. 4, 2009 Chinese office action in connection with counterpart Chinese application No. 2008-100873040.

*Primary Examiner* — Matthew Luu
*Assistant Examiner* — Brian J Goldberg
(74) *Attorney, Agent, or Firm* — Cooper & Dunham LLP

(57) ABSTRACT

A disclosed image forming apparatus includes a recording head configured to jet liquid droplets; a pattern forming unit configured to form, on a water-repellent surface of a water-repellent sheet member, an adjustment pattern used for correcting shifts in landing positions of the liquid droplets, wherein the adjustment pattern includes plural liquid droplets that are separated from each other, and the water-repellent surface having a water-repellent property is formed on at least a part of a surface of the water-repellent sheet member; a reading unit including a light emitting unit configured to irradiate light onto the adjustment pattern and a light receiving unit configured to receive specular reflection light from the adjustment pattern; and a landing position correction unit configured to correct, based on a reading result obtained by the reading unit, the shifts in the landing positions of the liquid droplets that are jetted from the recording head.

10 Claims, 32 Drawing Sheets

U.S. PATENT DOCUMENTS

| | | | | |
|---|---|---|---|---|
| 2005/0046658 | A1* | 3/2005 | Kojima | 347/19 |
| 2005/0073544 | A1* | 4/2005 | Scofield et al. | 347/16 |
| 2005/0194730 | A1 | 9/2005 | Nishida et al. | |
| 2007/0064032 | A1 | 3/2007 | Kawabata | |
| 2007/0120936 | A1 | 5/2007 | Kawabata | |

FOREIGN PATENT DOCUMENTS

| | | |
|---|---|---|
| JP | 5-249787 | 9/1993 |
| JP | 2005-342899 | 12/2005 |
| JP | 2006-178396 | 7/2006 |
| JP | 3838251 | 8/2006 |

* cited by examiner

ADJUSTMENT PATTERN 400

SENSOR OUTPUT VOLTAGE So

IMAGE FORMING APPARATUS, LANDING POSITION SHIFT CORRECTION METHOD, AND LANDING POSITION SHIFT CORRECTION SHEET MEMBER

BACKGROUND

1. Technical Field

This disclosure relates to an image forming apparatus including a recording head for jetting liquid droplets, a method of correcting shifts in landing positions of liquid droplets jetted from the recording head, and a landing position shift correction sheet member used for correcting shifts in the landing positions.

2. Description of the Related Art

There are image forming apparatuses such as printers, facsimile machines, copiers and multifunction peripherals having the aforementioned functions for performing image formation (recording, printing, etc., are also used synonymously) by the following method. That is, the image forming apparatus uses a liquid jetting device including a recording head with a liquid jetting head (liquid droplet jetting head) for jetting liquid droplets of a recording liquid (liquid). While a medium (hereinafter also referred to as "sheet", although the material is not limited, and a recording target medium, a recording medium, a transfer material, a recording sheet, etc., are also used synonymously) is being conveyed, the liquid jetting device jets the recording liquid (liquid) so that the recording liquid adheres onto the sheet.

An apparatus that forms images by jetting liquid onto a medium such as paper, strings, fiber, fabrics, leather, metal, plastic, glass, wood, ceramics, etc., is referred to as an image forming apparatus. Furthermore, "image formation" not only means to form images that have meaning such as characters or figures on a medium, but also means to form images without meaning such as patterns onto a medium. Therefore, textile printing equipment and devices for forming metal wiring are also included. Moreover, the liquid is not particularly limited as long as it is capable of forming images. Furthermore, a device for jetting liquid from a liquid jetting head is referred to as a liquid jetting device, which is not limited to that for forming images.

In such an image forming apparatus employing the liquid jetting method, when printing is performed bidirectionally in forward and backward directions by moving back and forth a carriage provided with a recording head for jetting liquid droplets, the following problem may arise. That is, if the image to be printed includes parallel horizontal lines, the position of a horizontal line printed in a forward direction may be shifted from that of a backward direction (i.e., the lines may not be parallel to each other).

For this reason, when using a typical inkjet recording apparatus, a test chart for adjusting positional shifts of horizontal lines is output manually. The user selects and inputs the optimum value. The timing for jetting ink is adjusted based on the input value. However, different individuals may view the test chart in different ways. Furthermore, if the user is not familiar with this operation, there may be errors in the input data. Therefore, adjustment failures may be caused in this method.

There are conventional techniques for correcting density inconsistencies in image forming apparatuses employing the liquid jetting method. For example, patent document 1 discloses a technique of printing a test pattern onto a recording medium or a conveying belt, reading color data of the test pattern, and changing the conditions for driving the head based on the read results to correct density inconsistencies.

Patent Document 1: Japanese Examined Patent Publication No. H4-39041

Furthermore, patent document 2 discloses a technique for detecting nozzle failures of the liquid jetting head. Specifically, a test pattern, which includes colored dots, which are a combination of cyan ink, magenta ink, and yellow ink, is formed in a predetermined region on a member for holding and conveying a printing medium. This combination of dots is read by an RGB sensor. Based on the read results, nozzles having jetting failures are detected.

Patent Document 2: Japanese Patent No. 3838251

Patent Document 3 discloses a technique of making corrections as follows. A test pattern is recorded onto a part of a conveying belt. The test pattern includes any one of an idling nozzle detection pattern for detecting an idling nozzle, a color shift detection pattern for detecting color shifts of ink, and a head position adjustment pattern for adjusting the position of the recording head, or a combination of these patterns. This test pattern is read by an image pick-up unit such as a CCD, and the correction is made based on this result.

Patent Document 3: Japanese Laid-Open Patent Application No. 2005-342899

Patent Document 4 discloses a technique of detecting the density of toner images with an image forming apparatus employing the electrophotographic method of using toner. Specifically, a toner image is formed on a photoconductive drum. The image forming apparatus includes light emitting elements and light receiving elements for detecting the density of a toner image. The light receiving elements include one for receiving specular reflection light and one for receiving scattered light. These elements individually detect densities of toner images having different characteristics.

Patent Document 4: Japanese Laid-Open Patent Application No. H5-249787

Patent document 5 discloses a technique for detecting the amount of adhering toner. Specifically, a sensor simultaneously detects specular reflection light and diffuse reflection light, which are reflected from a toner image that has been formed. The detection results output from this sensor are used for detecting the amount of adhering toner.

Patent Document 5: Japanese Laid-Open Patent Application No. 2006-178396

However, as described in patent documents 1 through 3, when a test pattern is formed on a conveying belt and the color of the test pattern is detected or the test pattern is read by an image pick-up unit, the following problem may arise. That is, depending on the combination of the color of the conveying belt and the color of the ink, the difference of colors between the conveying belt and test pattern may be small. Thus, it may be difficult to accurately read the test pattern. In such a case, in order to accurately detect the color, it may be necessary to use a light source that changes its wavelength for each color, which increases the cost of the detecting unit. For example, the conveying belt may be an electrostatic belt formed with an insulating layer on its front and a mid-resistance layer on its back, with carbon incorporated to make the mid-resistance layer conductive. The appearance of such an electrostatic belt is black. Therefore, in the process of detecting a test pattern, the electrostatic belt may not be distinguished from black ink, merely with the use of reflections from colors or with an image obtained by an image pick-up unit. For this reason, the test pattern may not be detected with high precision.

More specifically, in the device for correcting density inconsistencies disclosed in patent document 1, the colors are read with a sensor. Therefore, if the color of the jetted ink droplets were similar to the color of the holding/conveying member, the detection precision would decrease. Thus, each color needs to be detected through a filter. This increases the number and types of sensors and filters, which leads to increased costs. Furthermore, the device for detecting nozzle failures disclosed in patent document 2 uses an RGB sensor. Therefore, if the color of the jetted ink droplets were similar to the color of the holding/conveying member, the detection precision would decrease. In order to increase the detection precision, it will be necessary to limit the combinations of the ink and the holding/conveying member. Furthermore, if laser light were to be used, extremely small points would be scanned. For this reason, the detection operation would be affected even by small foreign matter particles or scratches on the conveying member, which decreases the detection precision. If an RGB sensor were to be used, it would be necessary to provide at least one unit for reading each of the colors, which leads to increased cost. Moreover, the device disclosed in patent document 3, which uses the image pick-up unit, has the same problem as that of patent document 2. That is, if the color of the jetted ink droplets and the color of the holding/conveying member were similar, the detection precision would decrease. Furthermore, the image is recognized as a two-dimensional image, which requires a processing system with higher performance than the case of recognizing a one-dimensional image, which leads to increased costs.

Accordingly, the methods disclosed in patent documents 4 and 5 for detecting the adhering toner amount in the electrophotographic method may be applied. Even when toner particles contact each other, the shape of each particle is maintained. For this reason, it is possible to read the toner density even at portions where the toner is so concentrated that it is piled up along a rectangular line. However, in the case of liquid droplets, the droplets cohere to each other. Therefore, if these methods (of patent documents 4 and 5) were to be directly applied to an image forming apparatus employing the liquid jetting method, it would be possible to perform the detection, but only to the extent of detecting noise. Thus, the test pattern may not be detected with high precision.

Furthermore, in a case where the test pattern is formed on plain paper, which is a recording target medium into which ink can permeate, and the test pattern is read by an optical sensor, the following problem arises. That is, the ink will permeate into the paper and form smears, such that the pattern becomes blurred. As a result, the landing positions may not be accurately detected.

BRIEF SUMMARY

In an aspect of this disclosure, there are provided an image forming apparatus, a landing position shift correction method, and a landing position shift correction sheet member with which a landing position shift correction adjustment pattern formed by liquid droplets can be detected with high precision, and landing position detection and landing position shift correction can be performed with high precision.

In another aspect, there is provided an image forming apparatus for forming an image on a recording target medium that is being conveyed, including a recording head configured to jet liquid droplets; a pattern forming unit configured to form, on a water-repellent surface of a water-repellent sheet member, an adjustment pattern used for correcting shifts in landing positions of the liquid droplets, wherein the adjustment pattern includes plural liquid droplets that are separated from each other, and the water-repellent surface having a water-repellent property is formed on at least a part of a surface of the water-repellent sheet member; a reading unit including a light emitting unit configured to irradiate light onto the adjustment pattern and a light receiving unit configured to receive specular reflection light from the adjustment pattern; and a landing position correction unit configured to correct, based on a reading result obtained by the reading unit, the shifts in the landing positions of the liquid droplets that are jetted from the recording head.

In another aspect, there is provided a method of correcting landing positions of liquid droplets jetted from a recording head, including a forming step of forming, on a water-repellent surface of a water-repellent sheet member, an adjustment pattern used for correcting shifts in the landing positions of the liquid droplets, wherein the adjustment pattern includes plural liquid droplets that are separated from each other, and the water-repellent surface having a water-repellent property is formed on at least a part of a surface of the water-repellent sheet member; a detecting step of detecting the adjustment pattern by irradiating light onto the adjustment pattern from a light emitting unit and receiving specular reflection light from the adjustment pattern with a light receiving unit; and a correcting step of correcting, based on a detection result obtained by detecting the adjustment pattern at the detecting step, the shifts in the landing positions of the liquid droplets that are jetted from the recording head.

Thus, an image forming apparatus, a landing position shift correction method, and a landing position shift correction sheet member can be provided, with which a landing position shift correction adjustment pattern formed by liquid droplets can be detected with high precision, and landing position detection and landing position shift correction can be performed with high precision.

BRIEF DESCRIPTION OF THE DRAWINGS

Other aspects, features and advantages will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 1:
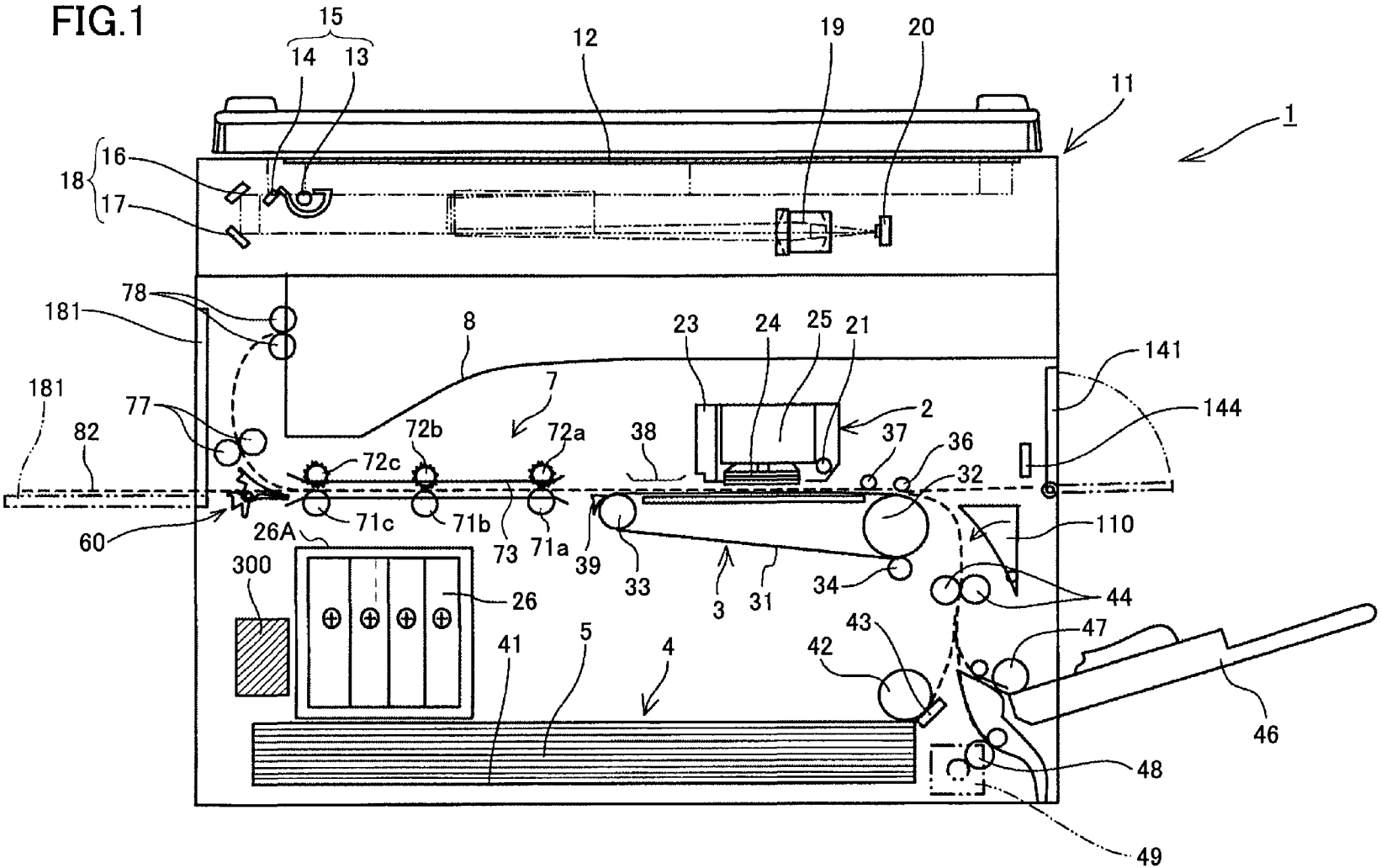
FIG. 1 is a schematic diagram illustrating the overall configuration of an image forming apparatus according to an embodiment of the present invention.

An overview of an image forming apparatus according to an embodiment of the present invention is described with reference to FIGS. 1 through 3. FIG. 1 is a schematic diagram illustrating the overall configuration of the image forming apparatus, FIG. 2 is a plan view of an image forming unit and a sub scanning conveying unit of the image forming apparatus, and FIG. 3 is a partially transparent side view of the same.

The image forming apparatus includes an image forming unit 2 and a sub scanning conveying unit 3 disposed inside an apparatus main body 1 (inside a casing). The image forming unit 2 is for forming images while sheets are being conveyed. The sub scanning conveying unit 3 is for conveying sheets. A sheet feeding unit 4 including a sheet feeding cassette disposed at the bottom of the apparatus main body 1 feeds sheets 5 one by one. The sub scanning conveying unit 3 conveys the sheet 5 to a position facing the image forming unit 2. While the sheet 5 is being conveyed, the image forming unit 2 jets liquid droplets onto the sheet 5 to form (record) a desired image. Subsequently, the sheet 5 is ejected, through a sheet eject conveying unit 7, onto a sheet eject tray 8 formed in the upper section of the apparatus main body 1.

Furthermore, the image forming apparatus includes, above the sheet eject tray 8 in the upper section of the apparatus main body 1, an image scanning unit (scanner unit) 11 for scanning images, which is an input system for image data (printing data) to be used by the image forming unit 2 to form an image. In the image scanning unit 11, a scanning optical system 15 including an illumination light source 13 and a mirror 14, and a scanning optical system 18 including mirrors 16 and 17 are moved along for scanning an image of an original placed on a contact glass 12. The scanned original image is read as image signals by an image reading element 20 disposed behind a lens 19. The image signals that have been read are converted into digital signals. Image processing is performed on these digital signals. The image-processed printing data can be printed out as an image.

Figure 2:
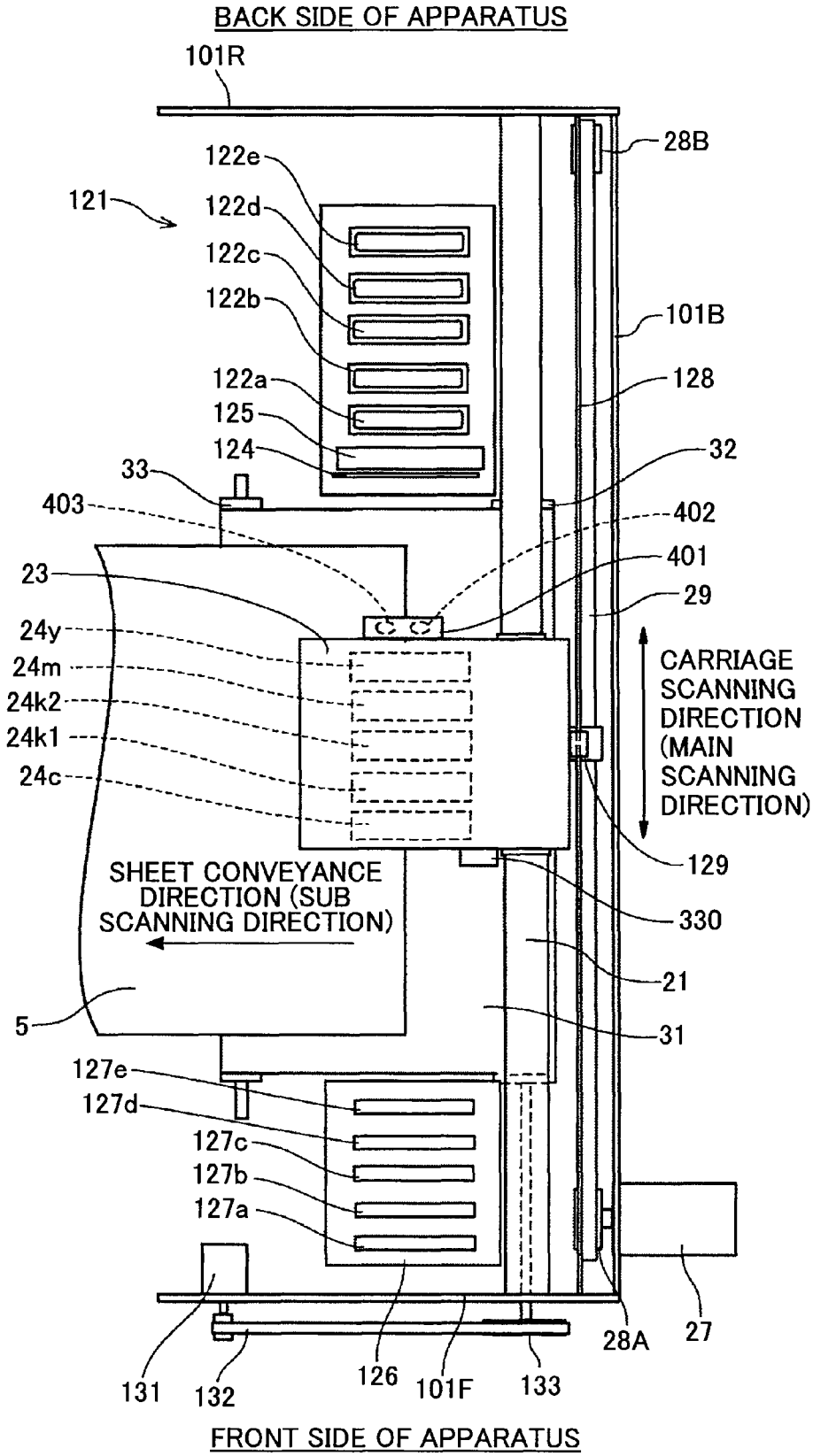
FIG. 2 is a plan view of an image forming unit and a sub scanning conveying unit of the image forming apparatus shown in FIG. 1.
Figure 3:
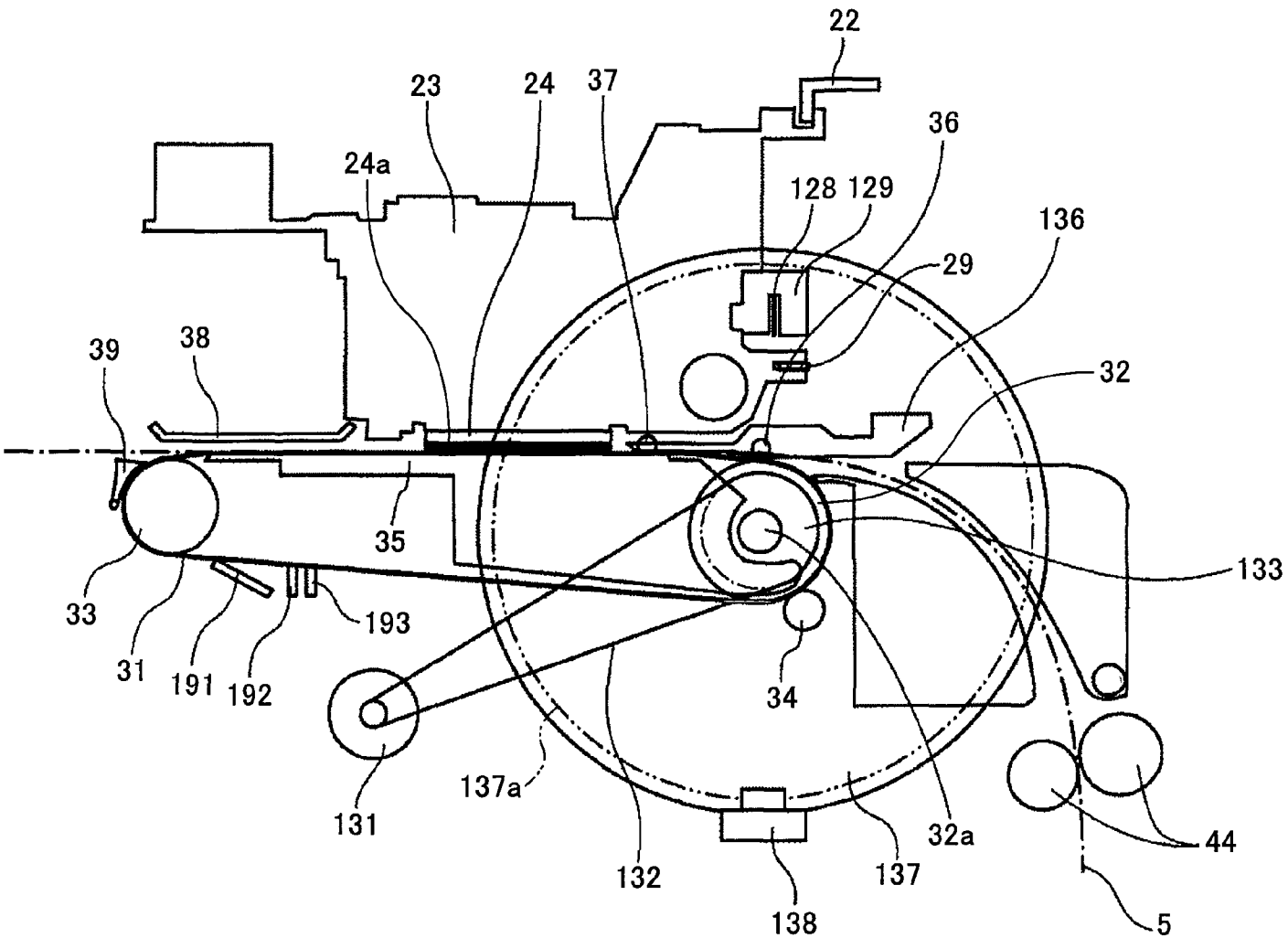
FIG. 3 is a partially transparent side view of the elements shown in FIG. 2.

As shown in FIG. 2, in the image forming unit 2 of this image forming apparatus, a cantilevered carriage 23 is held by a guide rod 21 and a not-shown guide rail in such a manner as to be movable in the main scanning direction. The carriage 23 is moved in the main scanning direction by a main scanning motor 27 via a timing belt 29 that is wound around a driving pulley 28A and a subordinate pulley 28B.

As shown in FIG. 2, in the image forming unit 2 of this image forming apparatus, the carriage 23 is held by the carriage guide (guide rod) 21 and a guide stay 22 (see FIG. 3) in such a manner as to be movable in the main scanning direction. The guide rod 21 is a main guide member bridged across a front side plate 101F and a rear side plate 101R. The guide stay 22 is a vertical guide member provided on a rear stay 101B. The carriage 23 is moved in the main scanning direction by the main scanning motor 27 via the timing belt 29 that is wound around the driving pulley 28A and the subordinate pulley 28B.

A total of five liquid droplet jetting heads are provided in the carriage 23. Specifically, there are recording heads 24*k*1, 24*k*2, which are two liquid droplet jetting heads for jetting black (K) ink, and recording heads 24*c*, 24*m*, and 24*y*, each including one liquid droplet jetting head for jetting cyan (C) ink, magenta (M) ink, and yellow (Y) ink, respectively (hereinafter referred to as "recording head 24" when the colors need not be distinguished and when referred to collectively). This carriage 23 is a shuttle type carriage that moves in the main scanning direction to form images by jetting liquid droplets from the recording heads 24, while the sheet 5 is being conveyed in the sheet conveyance direction (sub scanning direction) by the sub scanning conveying unit 3.

Furthermore, sub tanks 25 are provided in the carriage 23 for supplying recording liquid of necessary colors to the recording heads 24. Meanwhile, as shown in FIG. 1, ink cartridges 26 are removably attached to a cartridge insertion unit 26A from the front of the apparatus main body 1. The ink cartridges 26 are recording liquid cartridges for accommodating black (K) ink, cyan (C) ink, magenta (M) ink, and yellow (Y) ink. Ink (recording liquid) is supplied, through tubes, from the ink cartridges 26 each corresponding to one of the colors to the sub tanks 25 each corresponding to one of the colors. The black ink is supplied from one of the ink cartridges 26 to two of the sub tanks 25.

The recording head 24 can be a piezo type head, a thermal type head, or an electrostatic type head. In the piezo type head, a piezoelectric element is used as a pressure generating unit (actuator unit) for pressurizing the ink inside an ink flow path (pressure generating chamber). The walls of the ink flow path are formed with oscillating plates. These oscillating plates are caused to deform by the piezoelectric element, so that the volume inside the ink flow path changes and ink droplets are jetted outside. In the thermal type head, a heating element is used to heat the ink in the ink flow paths so that bubbles are generated. Due to pressure caused by these bubbles, the ink droplets are jetted outside. In the electrostatic type head, an oscillating plate forming a wall of the ink flow path is disposed in such a manner as to face an electrode. An electrostatic force is generated between the oscillating plate and the electrode. This electrostatic force causes the oscillating plate to deform, so that the volume inside the ink flow path changes and ink droplets are jetted outside.

Furthermore, a linear scale 128 having slits is stretched across from the front side plate 101F to the rear side plate 101R along the main scanning direction of the carriage 23. The carriage 23 is provided with an encoder sensor 129 that is a transmission photosensor for detecting the slits of the linear scale 128. The linear scale 128 and the encoder sensor 129 form a linear encoder for detecting movements of the carriage 23.

On one side of the carriage 23, a pattern reading sensor 401 is provided, which is a reading unit (detecting unit) configured with a reflection photosensor including a light emitting unit and a light receiving unit for reading a landing position detection adjustment pattern according to an embodiment of the present invention. This pattern reading sensor 401 reads a landing position detection adjustment pattern formed on a water-repellent sheet member, as described below. On the other side of the carriage 23, a sheet member detecting unit (leading edge detecting sensor) 330 is provided, which is a reflection photosensor for detecting the leading edge of a material being conveyed.

In a non-printing region on one side of the carriage 23 in the scanning direction, there is provided a maintaining/recovering mechanism (device) 121 for maintaining and recovering the operability of the nozzles of the recording head 24. This maintaining/recovering mechanism 121 is a cap member for capping a nozzle face 24*a* (see FIG. 3) of the five recording heads 24. The maintaining/recovering mechanism 121 includes one suction cap 122*a* that also serves as a moisture retention cap, four moisture retention caps 122*b* through 122*e*, a wiper blade 124 that is a wiping member for wiping the nozzle face 24*a* of the recording heads 24, and an idle jetting reception section 125 for performing idle jetting. In a non-printing region on the other side of the carriage 23 in the scanning direction, another idle jetting reception section 126 is provided for performing idle jetting. This idle jetting reception section 126 includes openings 127*a* through 127*e*.

As shown in FIG. 3, the sub scanning conveying unit 3 includes an endless conveying belt 31, a charging roller 34, a guide member 35, pressurizing rollers 36 and 37, a guide plate 38, and a separating claw 39. The conveying belt 31 is for changing the conveyance direction of the sheet 5, which has been fed from below, by substantially 90 degrees, and conveying the sheet 5 in such a manner as to face the image forming unit 2. The conveying belt 31 is stretched around a conveying roller 32 that is a driving roller and a subordinate roller 33 that is a tension roller. The charging roller 34 is a charging unit to which a high voltage alternating current is applied from a high voltage power source for charging the surface of the conveying belt 31. The guide member 35 is for guiding the conveying belt 31 in a region facing the image forming unit 2. The pressurizing rollers 36 and 37 are rotatably held by a holding member 136. The pressurizing rollers 36 and 37 are for pressing the sheet 5 against the conveying belt 31 at a position facing the conveying roller 32. The guide plate 38 is for guiding the top face of the sheet 5 with an image formed by the image forming unit 2. The separating claw 39 is for separating, from the conveying belt 31, the sheet 5 with an image.

Figure 4:
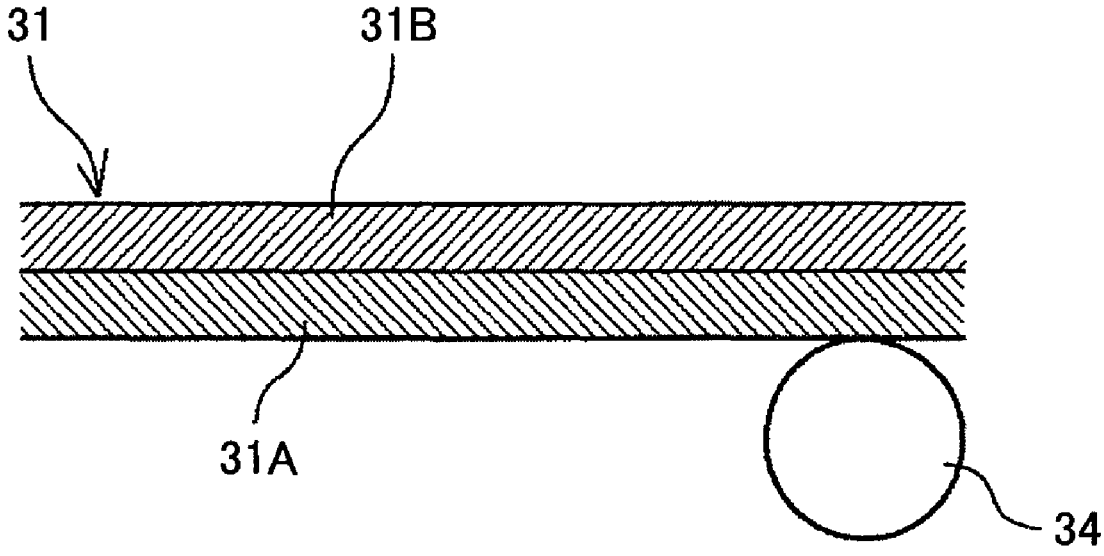
FIG. 4 is a cross-sectional view of an example of a conveying belt.

The conveying belt 31 is configured to revolve in the sheet conveyance direction (sub scanning direction) as the conveying roller 32 is rotated by a sub scanning motor 131 using a DC brushless motor via a timing belt 132 and a timing roller 133. As shown in FIG. 4, the conveying belt 31 has, for example, a two layer structure including a front layer 31A to which the sheet adheres and a back layer (mid-resistance layer, earth layer) 31B. The front layer 31A is made of a pure resin material such as an ETFE pure material that has not been subjected to resistance control. The back layer 31B is made of the same material as the front layer 31A except that carbon has been added to control the resistance. However, the structure is not limited thereto; the conveying belt 31 can have a single layer structure or a structure with three or more layers.

Furthermore, a Mylar (paper powder removing unit) 191, a cleaning brush 192, and a discharging brush 193 are provided between the subordinate roller 33 and the charging roller 34, arranged in this order from the upstream side of the movement direction of the conveying belt 31. The Mylar 191 is a cleaning unit for removing paper powder, etc., adhering to the surface of the conveying belt 31. The Mylar 191 is an abutment member made of a PET film, which abuts the surface of the conveying belt 31. The cleaning brush 192 is a brush that also abuts the surface of the conveying belt 31. The discharging brush 193 is for removing electric charges from the surface of the conveying belt 31.

Moreover, a high-resolution code wheel 137 is attached to a shaft 32*a* of the conveying roller 32. An encoder sensor 138 is provided, which is a transmission photosensor for detecting slits 137*a* formed on this code wheel 137. The code wheel 137 and the encoder sensor 138 form a rotary encoder.

The sheet feeding unit 4 includes a sheet feeding cassette 41, a sheet feeding roller 42, a friction pad 43, and a pair of resist rollers 44. The sheet feeding cassette 41 is an accommodation unit for accommodating multiple stacked sheets 5, which sheet feeding cassette 41 can be inserted in/removed from the apparatus main body 1. The sheet feeding roller 42 and the friction pad 43 are for separating the sheets 5 in the sheet feeding cassette 41 from each other and sending them out one by one. The resist rollers 44 are for resisting the sheet 5 being fed.

Furthermore, the sheet feeding unit 4 includes a manual feed tray 46, a manual feed roller 47, and a vertical conveying roller 48. The manual feed tray 46 is for accommodating multiple stacked sheets 5. The manual feed roller 47 is for feeding the sheets 5 one by one from the manual feed tray 46. The vertical conveying roller 48 is for conveying the sheet 5 that is fed from a sheet feeding cassette that is optionally installed at the bottom of the apparatus main body 1 or from a double-side unit. Members for feeding the sheet 5 to the sub scanning conveying unit 3, such as the sheet feeding roller 42, the resist rollers 44, the manual feed roller 47, and the vertical conveying roller 48, are rotated by a sheet feeding motor (driving unit) 49 that is an HB type stepping motor, via a not-shown electromagnetic clutch.

The sheet eject conveying unit 7 includes an openable/closable sheet eject guide plate 73 provided with three conveying rollers 71*a*, 71*b*, and 71*c* (referred to as "conveying rollers 71" when not distinguished) and spurs 72*a*, 72*b*, and 72*c* (referred to as "spurs 72" when not distinguished) that face the conveying rollers 71, a pair of reverse rollers 77, and a pair of reverse sheet eject rollers 78. The conveying rollers 71 are for conveying the sheet 5 which has been separated from the conveying belt 31 by the separating claw 39 of the sub scanning conveying unit 3. The reverse rollers 77 and the reverse sheet eject rollers 78 are for reversing the sheet 5 and sending the sheet 5 face-down to the sheet eject tray 8. Moreover, the sheet eject conveying unit 7 is provided with a separating claw 60 for conveying the sheet to the double-side unit in a case where the double-side unit is installed in the apparatus main body 1.

Furthermore, in order to manually feed a single sheet, as shown in FIG. 1, on one side of the apparatus main body 1 there is provided a single sheet manual feed tray 141 that can be opened and closed (in such a manner as to be unfolded) with respect to the apparatus main body 1. When a single sheet is to be fed manually, the single sheet manual feed tray 141 is opened (unfolded) to the position indicated by a horizontal virtual line. By opening this single sheet manual feed tray 141, a single sheet manual feed shutter 144 opens, so that the sheet 5 can enter the image forming unit 2. The sheet 5 that is fed manually from the single sheet manual feed tray 141 is guided along the top surface of a guide plate 110 and is then linearly inserted in between the conveying roller 32 and the pressurizing roller 36 of the sub scanning conveying unit 3.

Meanwhile, in order to eject the sheet 5 on which an image has been formed face-up and in a straight manner, a straight sheet eject tray 181 that can be opened and closed (unfolded) is provided on the other side of the apparatus main body 1. By opening (unfolding) this straight sheet eject tray 181, the sheet 5 that is sent out from the sheet eject conveying unit 7 can be linearly ejected to a stack part 82 of the straight sheet eject tray 181.

Figure 5:
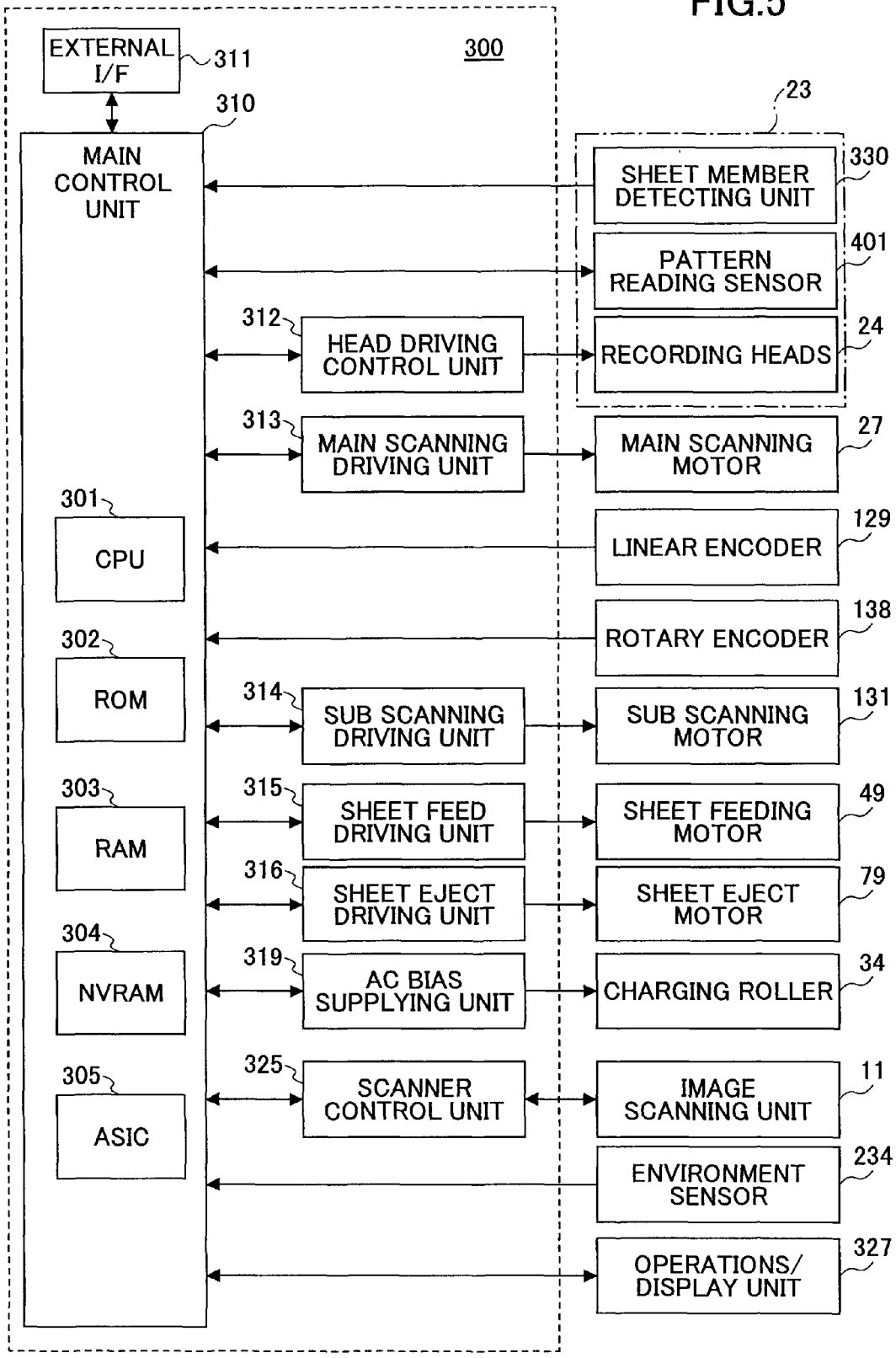
FIG. 5 is a block diagram for describing an overview of a control unit.

Next, an overview of a control unit of this image forming apparatus is described with reference to a block diagram shown in FIG. 5.

A control unit 300 includes a main control unit 310 for controlling the entire apparatus as well as specific operations according to embodiments of the present invention such as forming adjustment patterns, detecting adjustment patterns, and adjusting (correcting) landing positions. The main control unit 310 includes a CPU 301, a program to be executed by the CPU 301, a ROM 302 for storing other fixed data, a RAM 303 for temporarily storing image data, etc., a nonvolatile memory (NVRAM) 304 for holding data even while the power of the apparatus is shut off, and an ASIC 305 for performing various signal processings on the image data, image processings such as sorting, and other processings on input/output signals to control the entire apparatus.

Furthermore, the control unit 300 includes an external I/F 311, a head driving control unit 312, a main scanning driving unit (motor driver) 313, a sub scanning driving unit (motor driver) 314, a sheet feed driving unit 315, a sheet eject driving unit 316, and an AC bias supplying unit 319. The external I/F 311 is provided between the host side and the main control unit 310 for transmitting/receiving data and signals. The head driving control unit 312 includes a head driver (actually provided in the recording head 24) configured with a head data generating rearranging ASIC for driving/controlling the recording head 24. The main scanning driving unit 313 is for driving the main scanning motor 27 to move the carriage 23. The sub scanning driving unit 314 is for driving the sub scanning motor 131. The sheet feed driving unit 315 is for driving the sheet feeding motor 49. The sheet eject driving unit 316 is for driving a sheet eject motor 79 which drives the rollers of the sheet eject conveying unit 7. The AC bias supplying unit 319 is for supplying an AC bias to the charging roller 34. Although not shown, the control unit 300 also includes a recovering system driving unit for driving a maintaining/recovering motor which drives the maintaining/recovering mechanism 121, a double side driving unit for driving a double side unit if the double side unit is installed, a solenoid driving unit (driver) for driving various solenoids (SOL), a clutch driving unit for driving electromagnetic clutches, and a scanner control unit 325 for controlling the image scanning unit 11.

Various detection signals of an environment sensor 234 for detecting, for example, the temperature and the humidity around the conveying belt 31 (environment conditions) are input to the main control unit 310. Detection signals of other not-shown sensors are also input to the main control unit 310. Furthermore, the main control unit 310 acquires necessary key input from various keys provided in the apparatus main body 1 such as a numeric keypad and a print start key, and outputs display information to an operations/display unit 327 including various display devices.

Moreover, output signals from the photosensor (encoder sensor) 129, which is a part of the linear encoder for detecting the above-described carriage position, are input to the main control unit 310. Based on these output signals, the main control unit 310 moves the carriage 23 back and forth in the main scanning direction by driving/controlling the main scanning motor 27 via the main scanning driving unit 313. Furthermore, output signals (pulses) from the photosensor (encoder sensor) 138, which is a part of the rotary encoder for detecting the movement amount of the above-described conveying belt 31, are input to the main control unit 310. Based on these output signals, the main control unit 310 moves the conveying belt 31 via the conveying roller 32 by driving/controlling the sub scanning motor 131 via the sub scanning driving unit 314.

The main control unit 310 moves a water-repellent sheet member to a position for forming an adjustment pattern based on detection signals from the sheet member detecting unit 330. The main control unit 310 performs a process for forming an adjustment pattern on the water-repellent sheet member. The main control unit 310 performs a light emitting driving control operation for emitting light onto the formed adjustment pattern from the pattern reading sensor 401 installed in the carriage 23. Output signals from the light receiving unit are input to the main control unit 310 to detect the adjustment pattern and to detect the landing position shift amount. Based on these detection results, the main control unit 310 performs a control operation to correct the timings at which liquid droplets are jetted from the recording heads 24 so as to eliminate shifts of landing positions.

A brief description is given of an image forming operation of the image forming apparatus having the above configuration. The rotation amount of the conveying roller 32 for driving the conveying belt 31 is detected. According to the detected rotation amount, the sub scanning motor 131 is driven/controlled, and high voltage alternating current rectangular waves of positive and negative polarities are applied from the AC bias supplying unit 319 to the charging roller 34. Accordingly, positive and negative charges are alternately applied onto the conveying belt 31 in a striped manner with respect to the conveyance direction of the conveying belt 31.

Thus, the conveying belt 31 is charged with predetermined charge widths so that a non-uniform electric field is generated.

The sheet 5 is fed from the sheet feeding unit 4, and is sent in between the conveying roller 32 and the first pressurizing roller 36. When the sheet 5 is sent onto the conveying belt 31, on which charges of positive and negative polarities are formed so that a non-uniform electric field is generated, the sheet 5 immediately becomes polarized according to the direction of the electric field. Then, the sheet 5 adheres onto the conveying belt 31 due to an electrostatic adhering force, so that it is conveyed along with the movement of the conveying belt 31.

The sheet 5 is intermittently conveyed by the conveying belt 31. The carriage 23 is moved in the main scanning direction to jet liquid droplets of recording liquid from the recording heads 24 onto the halting sheet 5 to record (print) an image. The leading edge of the sheet 5 which has undergone the printing operation is separated from the conveying belt 31 with the separating claw 39. The sheet 5 is then sent out to the sheet eject conveying unit 7 and is ejected onto the sheet eject tray 8.

Furthermore, during standby periods between printing (recording) operations, the carriage 23 is moved to the maintaining/recovering mechanism 121. The nozzle faces of the recording heads 24 are capped by caps 122 so that the nozzles are maintained in a moist state. This prevents jetting failures that may be caused when the ink becomes dry. Furthermore, a recovery operation is performed by suctioning the recording liquid through the nozzles and discharging viscous recording liquid and bubbles, where the recording heads 24 are capped by suction and moisture retention caps 122. By performing this recovery operation, ink adheres to the nozzle faces of the recording heads 24. In order to clean/remove this ink, the wiper blade 124 wipes off the ink. Furthermore, before starting the recording operation or during the recording operation, the recording heads 24 perform idle jetting operations by jetting ink into the idle jetting reception section 125, which ink is unrelated to the recording operation. Accordingly, the jetting performance of the recording heads 24 can be maintained at a stable level.

Figure 6:
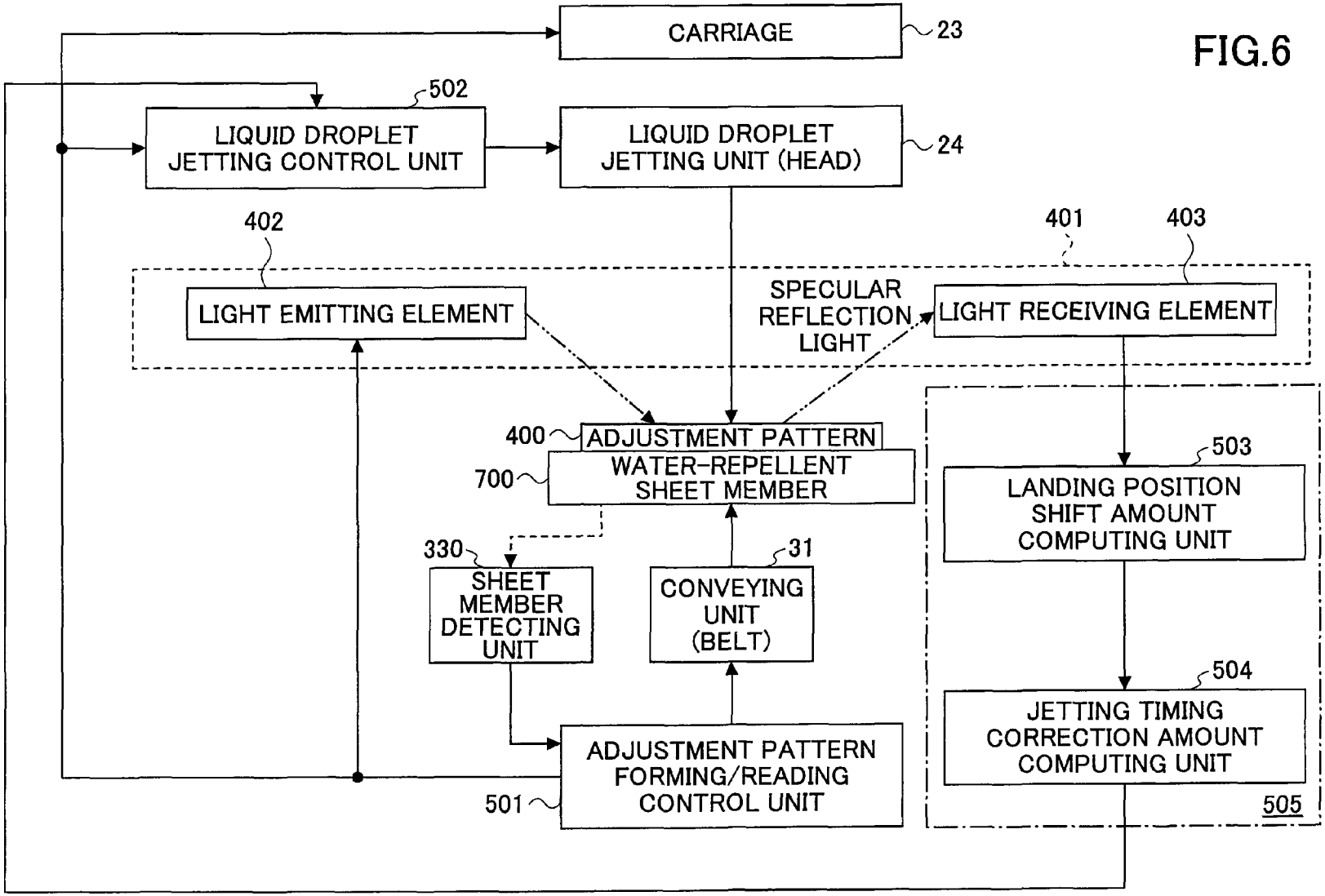
FIG. 6 is a functional block diagram of parts relevant to detecting and correcting liquid droplet landing positions for describing a first embodiment of the present invention.
Figure 7:
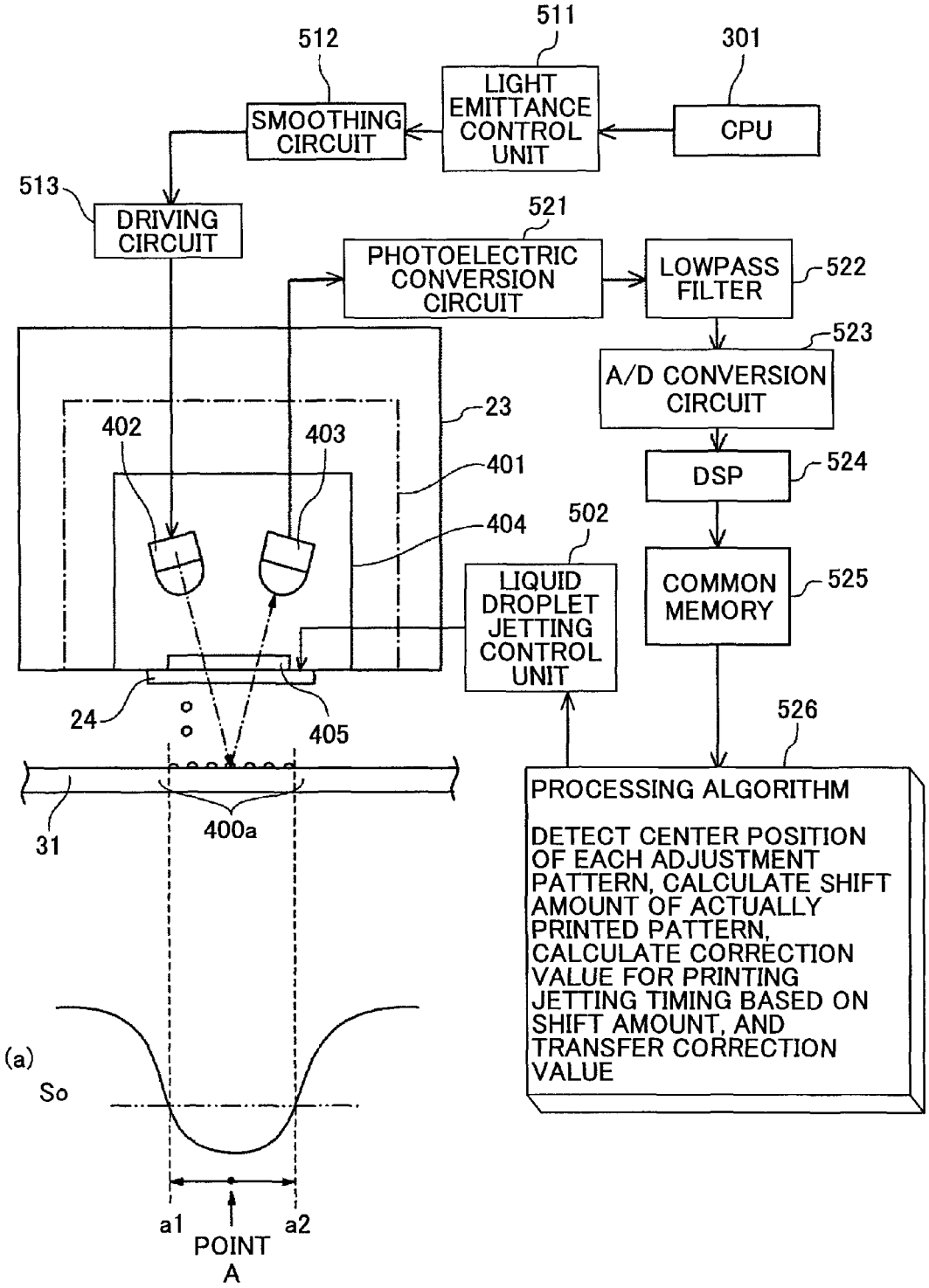
FIG. 7 is also a functional block diagram of a specific example of parts relevant to detecting and correcting liquid droplet landing positions.

Next, the units relevant to liquid droplet landing position shift correction control in the image forming apparatus are described with reference to FIGS. 6 and 7. FIG. 6 is a block diagram illustrating the functions of the liquid droplet landing position shift correction unit. FIG. 7 is a block diagram of the functional flow of the liquid droplet landing position shift correction operation.

Figure 9:
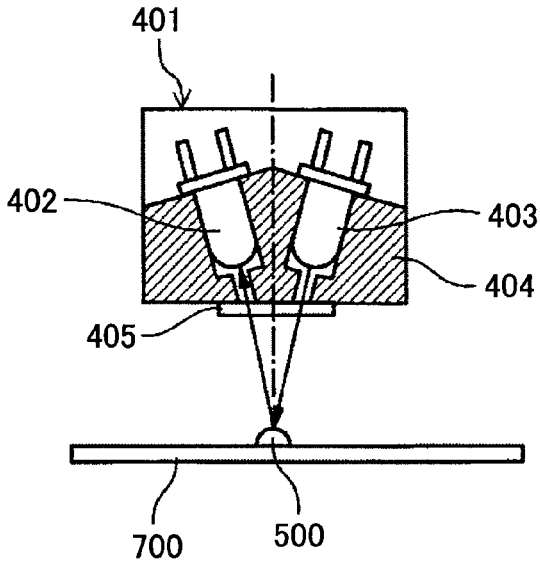
FIG. 9 illustrates a reading sensor.

As shown in FIGS. 7 and 9, the carriage 23 is provided with the pattern reading sensor 401 for reading an adjustment pattern (also referred to as DRESS pattern, test pattern, detection pattern, etc.) 400, which is formed on a water-repellent sheet member 700. The pattern reading sensor 401 includes a light emitting element 402 and a light receiving element 403, which are arranged in a direction perpendicular to the main scanning direction, and are held and packaged in a holder 404. The light emitting element 402 is a light emitting unit for emitting light onto the adjustment pattern 400 on the water-repellent sheet member 700. The light receiving element 403 is a light receiving unit for receiving specular reflection light from the adjustment pattern 400. A lens 405 is provided at the light beam outgoing part and the light beam incoming part of the holder 404.

Inside the pattern reading sensor 401, the light emitting element 402 and the light receiving element 403 are arranged in a direction perpendicular to the main scanning direction of the carriage 23, which main scanning direction is indicated in FIG. 2. Accordingly, the detection results (reading results) are less affected by fluctuations in the movement speed of the carriage 23. Furthermore, a relatively simple and inexpensive light source can be used as the light emitting element 402, for example, light of an infrared region such as an LED or visible light. Furthermore, the spot diameter (detection range, detection region) of the light source is detected in units of millimeters because an inexpensive lens is used instead of a high-precision lens.

Figure 8:
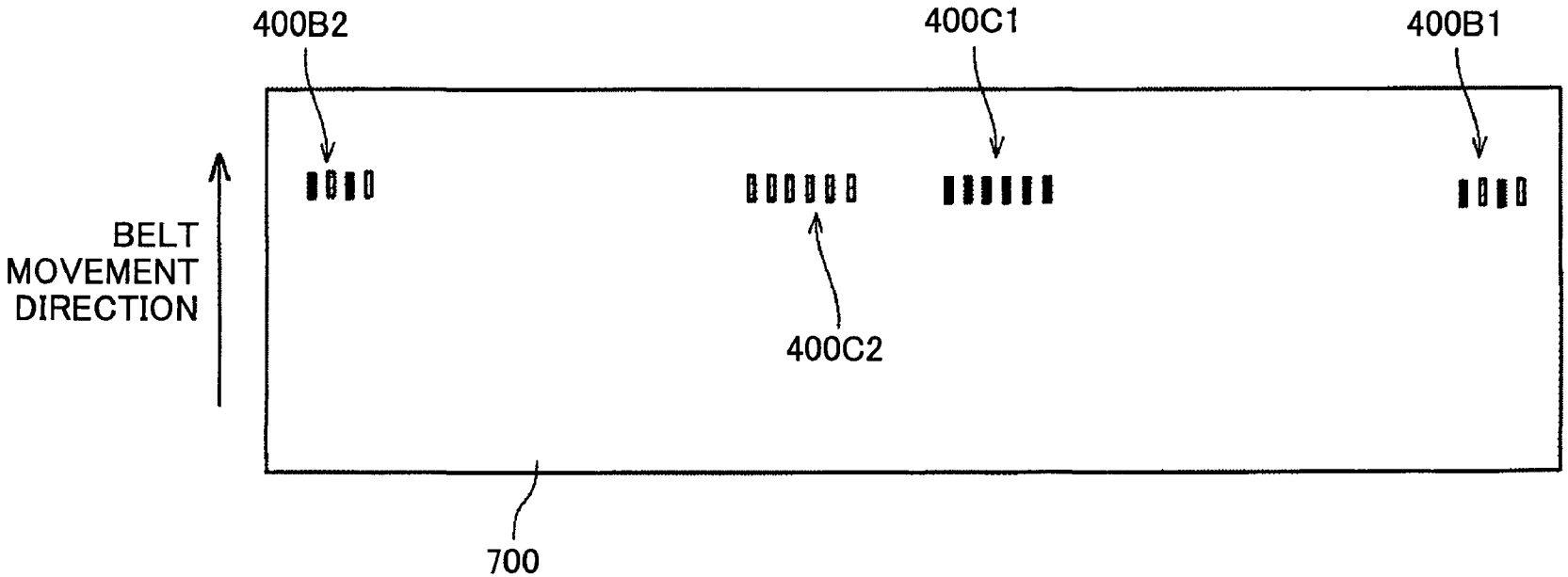
FIG. 8 illustrates examples of adjustment patterns.

An adjustment pattern forming/reading control unit 501 causes the conveying belt 31 to convey the water-repellent sheet member 700. When the sheet member detecting unit 330 detects the leading edge of the water-repellent sheet member 700, the water-repellent sheet member 700 is further conveyed to the position for forming the adjustment pattern 400. Subsequently, the carriage 23 is moved back and forth in the main scanning direction while a liquid droplet jetting control unit 502 causes the recording heads 24, which are liquid droplet jetting units, to jet liquid droplets. Accordingly, the line-shaped adjustment patterns 400 (400B1, 400B2, 400C1, 400C1, and so forth) as shown in FIG. 8 are formed with plural liquid droplets (ink drops) 500 on the water-repellent sheet member 700. The adjustment pattern forming/reading control unit 501 is a part of the CPU 301 of the main control unit 310.

The adjustment pattern forming/reading control unit 501 reads, with the pattern reading sensor 401, the adjustment pattern 400 formed on the water-repellent sheet member 700. This adjustment pattern reading control operation is performed by emitting light from the light emitting element 402 of the pattern reading sensor 401 while moving the carriage in the main scanning direction. Specifically, as shown in FIG. 7, the CPU 301 of the main control unit 310 sets, in a light eminence control unit 511, a PWM value for driving the light emitting element 402 of the pattern reading sensor 401. Output from the light eminence control unit 511 is smoothed by a smoothing circuit 512, and the smoothed output is supplied to a driving circuit 513. Accordingly, the driving circuit 513 causes the light emitting element 402 to emit light, so that light output from the light emitting element 402 is irradiated onto the adjustment pattern 400 on the water-repellent sheet member 700.

In the pattern reading sensor 401, as light output from the light emitting element 402 is irradiated onto the adjustment pattern 400 on the water-repellent sheet member 700, the specular reflection light reflected from the adjustment pattern 400 is irradiated into the light receiving element 403. The light receiving element 403 outputs detection signals according to the amount of the specular reflection light received from the adjustment pattern 400. These detection signals are input to a landing position shift amount computing unit 503 of a landing position correction unit 505. Specifically, as shown in FIG. 7, the output signals from the light receiving element 403 of the pattern reading sensor 401 are subjected to photoelectric conversion with a photoelectric conversion circuit 521 (not shown in FIG. 5) included in the main control unit 310. Noise components are removed from these photoelectric-converted signals (sensor output voltage) with a lowpass filter 522. Then, the signals are subjected to A/D conversion with an A/D conversion circuit 523. The A/D converted sensor output voltage data are loaded in a common memory 525 by a signal processing circuit (DSP) 524.

The landing position shift amount computing unit 503 of the landing position correction unit 505 detects the position of the adjustment pattern 400 based on output results from the light receiving element 403 of the pattern reading sensor 401, and calculates the shift amount with respect to a standard position (liquid droplet landing position shift amount). The landing position shift amount calculated by the landing position shift amount computing unit 503 is given to a jetting timing correction amount computing unit 504. The jetting timing correction amount computing unit 504 calculates the correction amount of the jetting timing so that there are no shifts in the landing position when the liquid droplet jetting control unit 502 drives the recording heads 24. The jetting timing correction amount computing unit 504 sets the calculated jetting timing correction amount in the liquid droplet jetting control unit 502. Accordingly, the liquid droplet jetting control unit 502 can drive the recording heads 24 at jetting timings that have been corrected based on the correction amount. Thus, the shifts in the liquid droplet landing positions can be reduced.

Specifically, as shown in FIG. 7, with the use of a processing algorithm 526 that is executed by the CPU 301, the center position (point A) of each adjustment pattern 400 (one of the line patterns is denoted by "400*a*") is detected from a sensor output voltage So as indicated by (a) in FIG. 7 loaded in the common memory 525. Then, the jetting timing correction amount computing unit 504 calculates the shift amount of the actual landing position of liquid jetted from the corresponding head with respect to a standard position (standard head). Based on the shift amount, the jetting timing correction amount computing unit 504 calculates the correction amount of the printing jetting timings. The jetting timing correction amount computing unit 504 sets this correction amount in the liquid droplet jetting control unit 502.

The adjustment pattern 400 according to an embodiment of the present invention is further described with reference to FIG. 10 onward.

First, a description is given of the principle of landing position detection (pattern detection) according to an embodiment of the present invention. With reference to FIG. 10, a description is given of how light diffuses from a liquid droplet (hereinafter, "ink drop") when the light is irradiated onto the ink drop.

Figure 10:
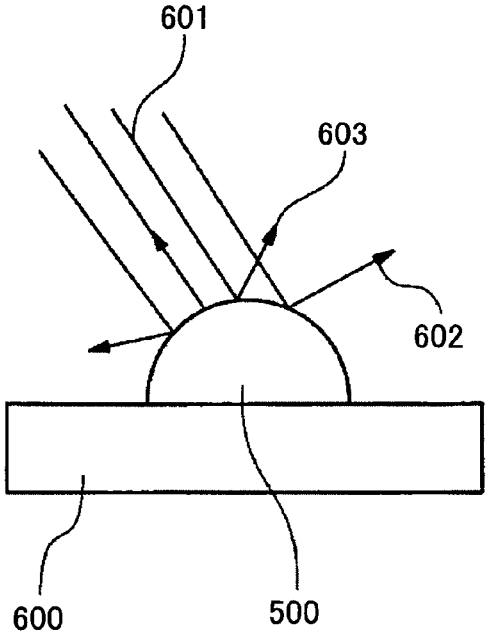
FIG. 10 illustrates how light diffuses from a liquid droplet for describing the principle of pattern detection.
Figure 11:
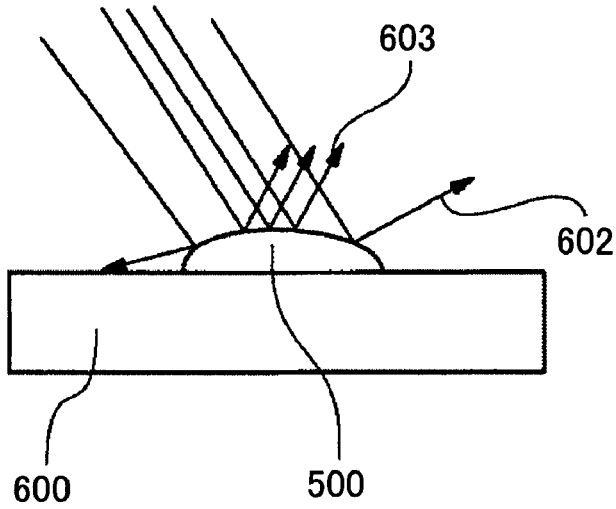
FIG. 11 illustrates how light diffuses when the liquid droplet has become flat.
Figure 12:
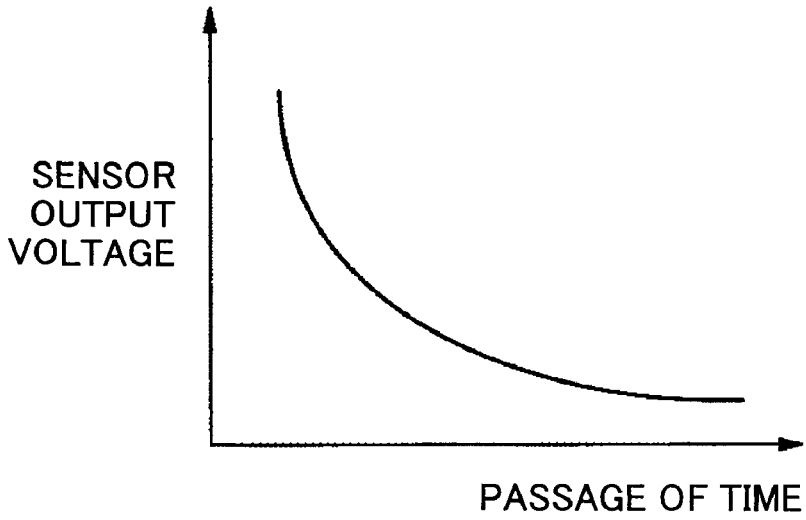
FIG. 12 illustrates the relationship between the passage of time after the liquid droplet lands and the sensor output voltage.

As shown in FIG. 10, incident light 601 hits an ink drop 500 that has landed on a landing target member 600 (the landed ink drop becomes a hemisphere). Because the liquid droplet 500 has a round, lustrous surface, most of the incident light 601 turns into diffuse reflection light 602. Hence, only a small amount of the light can be detected as specular reflection light 603. However, as shown in FIG. 11, the liquid droplet 500 dries with the passage of time, and therefore the surfaces looses luster, and the shape gradually changes into a flat shape from the hemispheric shape. As a result, the range and proportion of the specular reflection light 603 becomes relatively larger than those of the diffuse reflection light 602. Thus, when the specular reflection light 603 is received by the light receiving element 403, as shown in FIG. 12, the sensor output voltage decreases with the passage of time, and therefore the detection precision also decreases with the passage of time.

Figure 13:
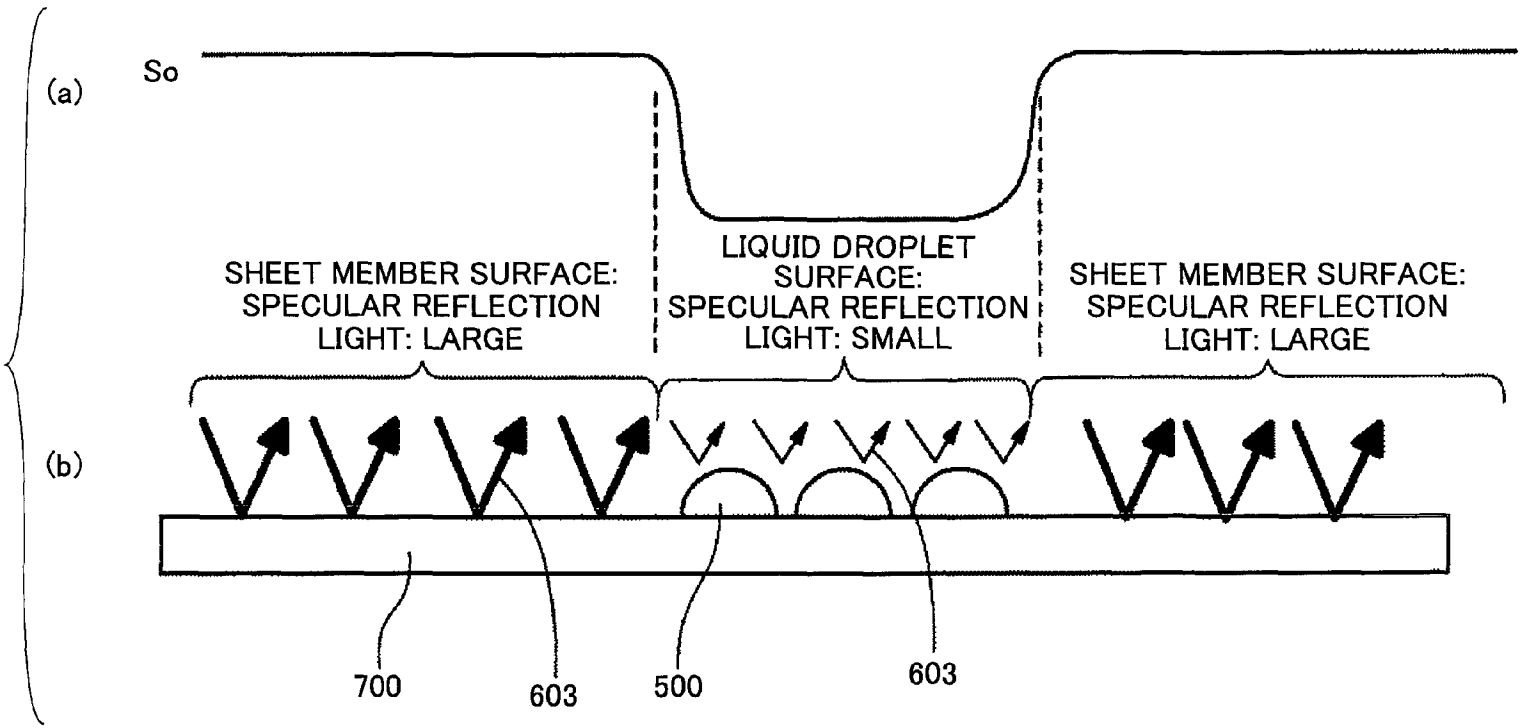
FIG. 13 is a schematic diagram illustrating an adjustment pattern according to an embodiment of the present invention.

Next, with reference to FIG. 13, a description is given of the operation of detecting the position of the ink drop 500 included in the adjustment pattern 400 (more specifically, one pattern 400*a*).

The surface of the water-repellent sheet member 700 is lustrous, and therefore tends to reflect specular reflection light when light is received from the light emitting element 402. For this reason, as indicated by (b) in FIG. 13, the amount of specular reflection light 603 is large in the region on the water-repellent sheet member 700 without any ink drops 500, because almost all of incident light 601 from the pattern reading sensor 401 becomes specular reflection light when reflected from the water-repellent sheet member 700. Accordingly, as indicated by (a) in FIG. 13, the output (sensor output voltage) from the light receiving element 403 for receiving the specular reflection light 603 is relatively large.

Meanwhile, as indicated by (b) in FIG. 13, in the region where the landed ink drops 500 are separated from each other but close to each other, the amount of the specular reflection light 603 is reduced because the light is diffused on the surfaces of the lustrous, hemispheric ink drops 500. Therefore, as indicated by (a) in FIG. 13, the output (sensor output voltage) from the light receiving element 403 for receiving the specular reflection light 603 is relatively small. Incidentally, when ink drops that are "close to each other" refers to where the area between the ink drops 500 is smaller than the area on which the ink drops 500 have landed (adhering area), within a predetermined detection region.

Figure 14:
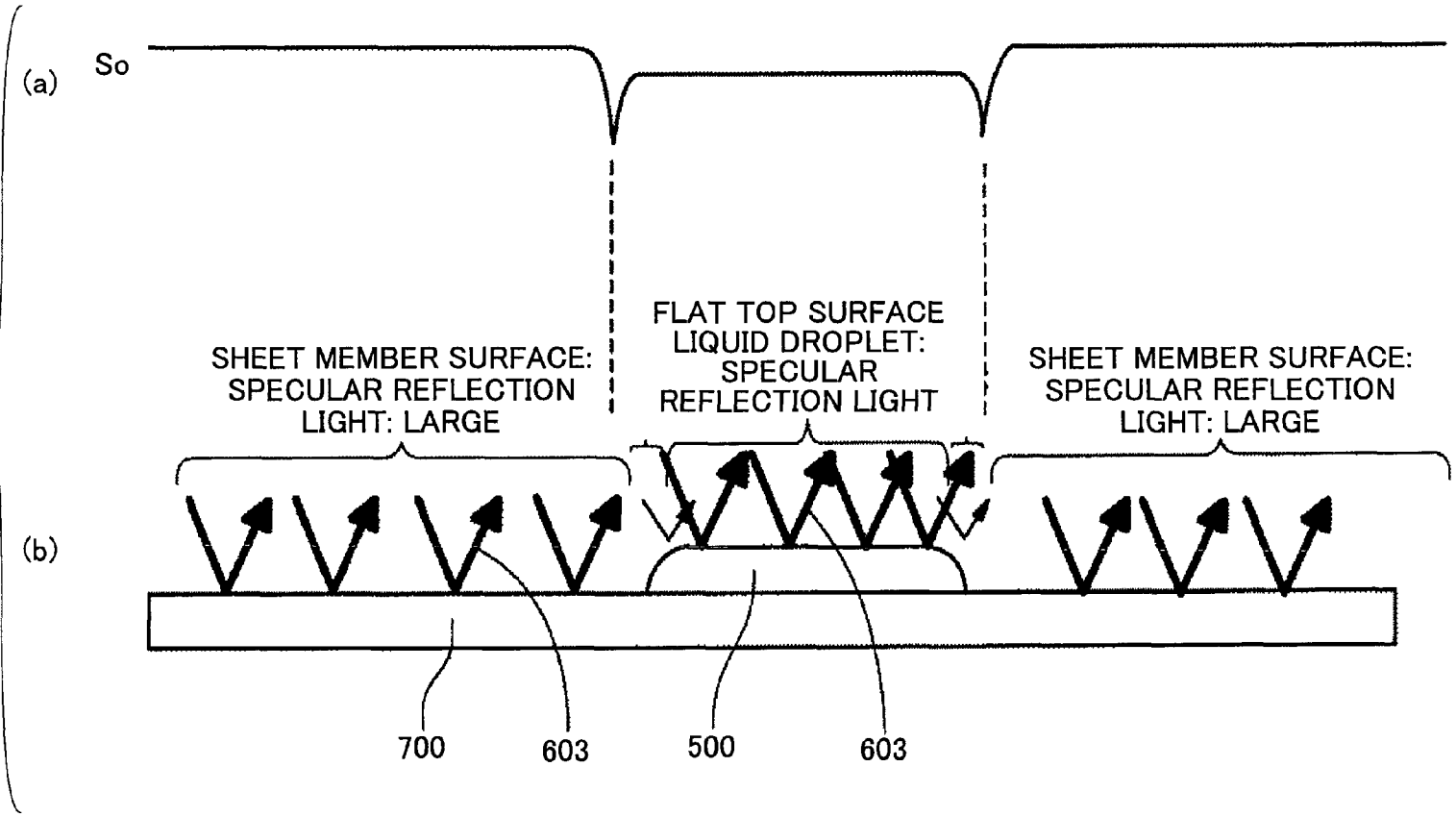
FIG. 14 is a schematic diagram illustrating an adjustment pattern of a comparative example.

In a comparative example, as indicated by (b) in FIG. 14, when the adjacent ink drops have contacted each other and have become connected to each other on the water-repellent sheet member 700, the top surface of the connected ink drops 500 becomes flat. As a result, the amount of specular reflection light 603 will increase. Therefore, as indicated by (a) in FIG. 14, the output value of the sensor output voltage will become substantially the same for the region on the water-repellent sheet member 700 without the ink drops 500 and the region with the ink drops 500, which makes it difficult to detect the positions of the ink drops 500. Even when the ink drops 500 have become connected to each other, diffuse light is generated at the edges of the connected ink drop 500. Nevertheless, detection is still difficult because the diffuse light is generated from extremely small portions. If an attempt were made to detect the ink drops, the area to be examined with the light receiving element 403 (region to be detected) would need to be narrowed down. Accordingly, the detection may be affected by noise elements such as slight scratches or dust on the surface of the water-repellent sheet member 700, which may decrease the detection precision and/or degrade the reliability of detection results.

The landing positions of ink drops can be detected by identifying the portions where specular reflection light is attenuated, from the output from the light receiving unit for receiving specular reflection light from the ink drops. In order to detect the landing positions of ink drops with high precision, the adjustment pattern 400 needs to include plural liquid droplets that are separated from each other but close to each other (in the detection region, the area between the ink drops is smaller than the adhering area where the ink drops are adhering to the member). By forming such an adjustment pattern, the adjustment pattern (liquid droplet landing position) can be detected with high precision with a simple structure including a light emitting unit and a light receiving unit.

Figure 15:
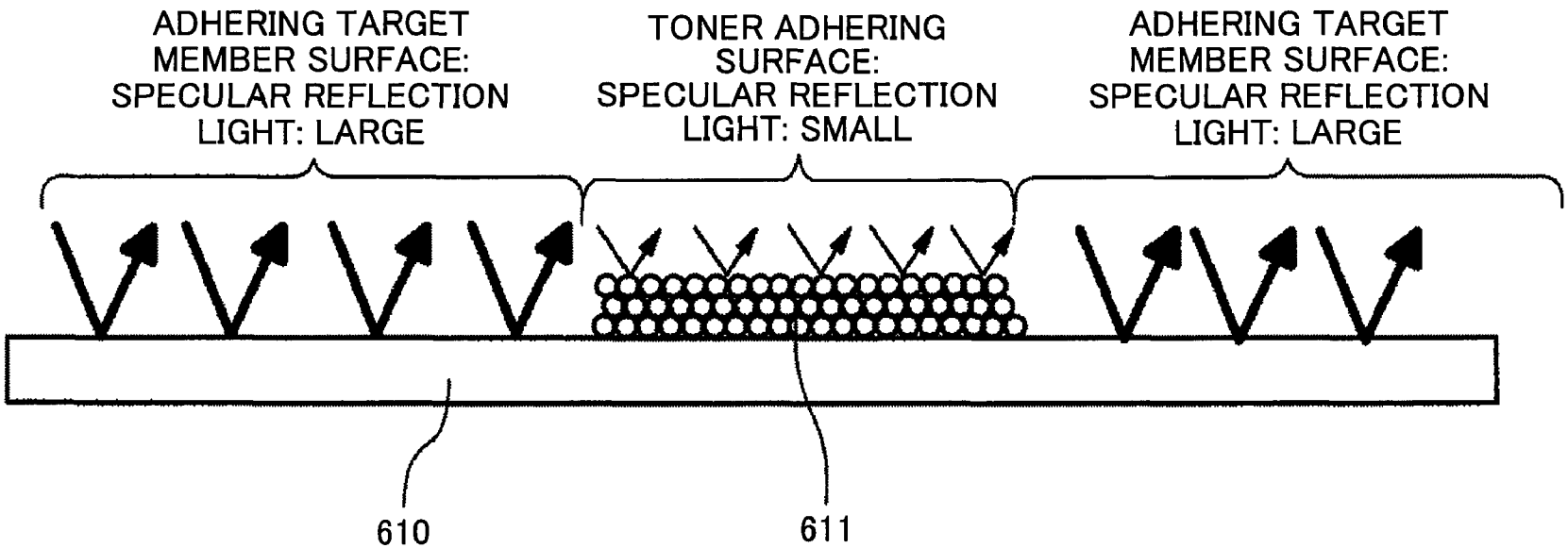
FIG. 15 is a schematic diagram for making a comparison with an adjustment pattern formed with toner.

The difference between toner used in an electrophotographic method and liquid droplets used in the liquid jetting method is described with reference to FIG. 15.

The shape of each toner particle used in an electrophotographic method is maintained even when the toner is adhering to an adhering target member. Therefore, even when toner particles 611 included in the adjustment pattern on a adhering target member 610 are stacked on top of each other as shown in FIG. 15, the amount of specular reflection light from an area on the adhering target member 610 on which toner is adhering (toner adhering surface) is smaller than that from an area on the adhering target member 610 without any toner. Accordingly, the adjustment pattern can be detected with the output from the light receiving unit for receiving specular reflection light.

Conversely, liquid droplets have a peculiar property. As described above, when liquid droplets that have landed on the landing target member become connected with adjacent liquid droplets, the top part becomes flat. As a result, the amount of specular reflection light from the connected liquid droplets will become substantially the same as that from the surface of the landing target member without any liquid droplets. If the adjustment pattern is simply detected according to the difference in the amount of specular reflection light received from the adjustment pattern, without considering such a peculiar property of liquid droplets, the detection precision will be significantly degraded. Particularly, when the adjustment pattern is formed by making ink drops land onto a media into which ink can permeate, such as a recording target medium, the pattern may not be accurately detected.

An embodiment of the present invention takes into consideration this peculiar property of liquid droplets. That is, an adjustment pattern is formed on a water-repellant sheet member. On this water-repellant sheet member, an adjustment pattern is formed with plural liquid droplets that are separated from each other. The area between the liquid droplets is smaller than the area where the liquid droplets are adhering to the member, within the detection region. Accordingly, the adjustment pattern can be detected with high precision based on the difference in the amount of specular reflection light from the adjustment pattern. As a result, shifts in liquid droplet landing positions can be adjusted (corrected) with high precision.

Next, different examples of a position detection process (reading process) of the adjustment pattern 400 formed on the water-repellent sheet member 700 is described with reference to FIGS. 16A through 18.

Figure 16A:
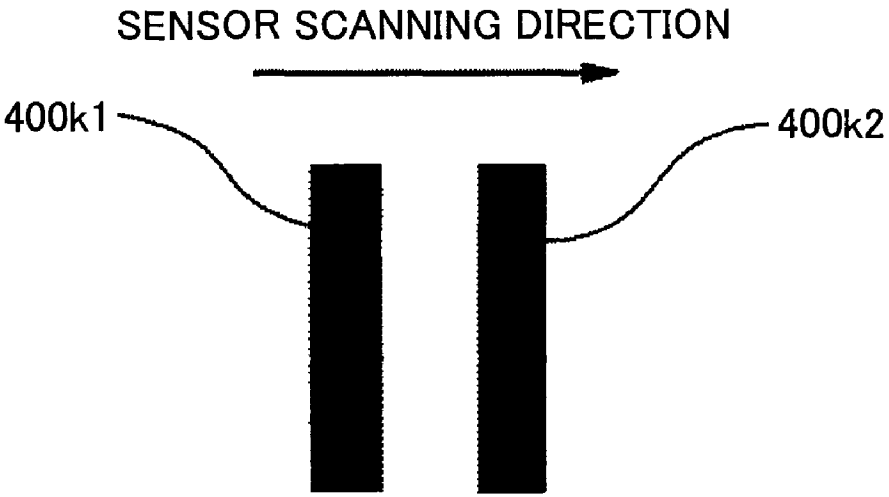
FIGS. 16A and 16B illustrate a first example of a process for detecting the position of an adjustment pattern.
Figure 16B:
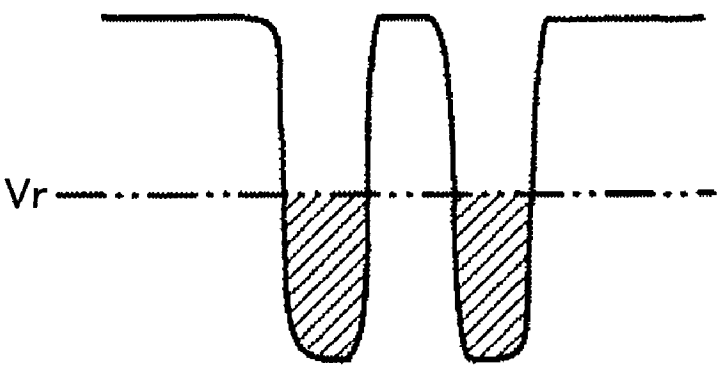

FIGS. 16A and 16B illustrate a first example. For example, as shown in FIG. 16A, a line-shaped pattern 400*k*1 is formed with the recording head 24*k*1, and a line-shaped pattern 400*k*2 is formed with the recording head 24*k*2. These are scanned with the pattern reading sensor 401 in the sensor scanning direction (carriage main scanning direction). Based on the output results from the light receiving element 403 of the pattern reading sensor 401, as shown in FIG. 16B, a sensor output voltage So is obtained, which falls at the pattern 400*k*1 and the pattern 400*k*2.

By comparing this sensor output voltage So with a predetermined threshold Vr, the positions at which the sensor output voltage So becomes lower than the threshold Vr can detected as edges of the pattern 400*k*1 and the pattern 400*k*2. The area centroid of the region surrounded by the lines representing the threshold Vr and the sensor output voltage So (the hatched parts in the figure) is calculated. This area centroid can be set to be the center of the adjustment pattern 400. By using a centroid, it is possible to reduce errors caused by microscopic variations of the sensor output voltage.

Figure 17A:
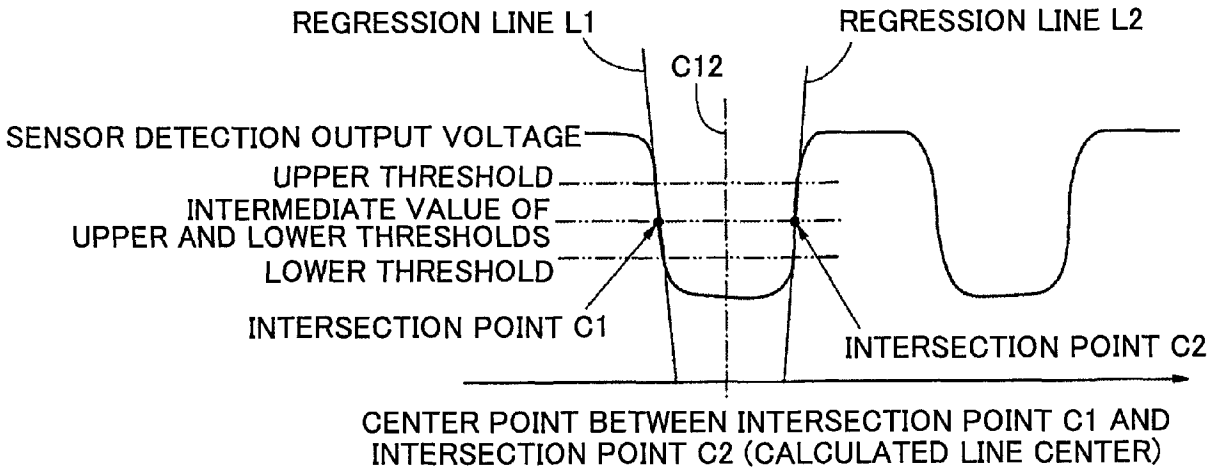
FIGS. 17A and 17B illustrate a second example of a process for detecting the position of an adjustment pattern.
Figure 17B:
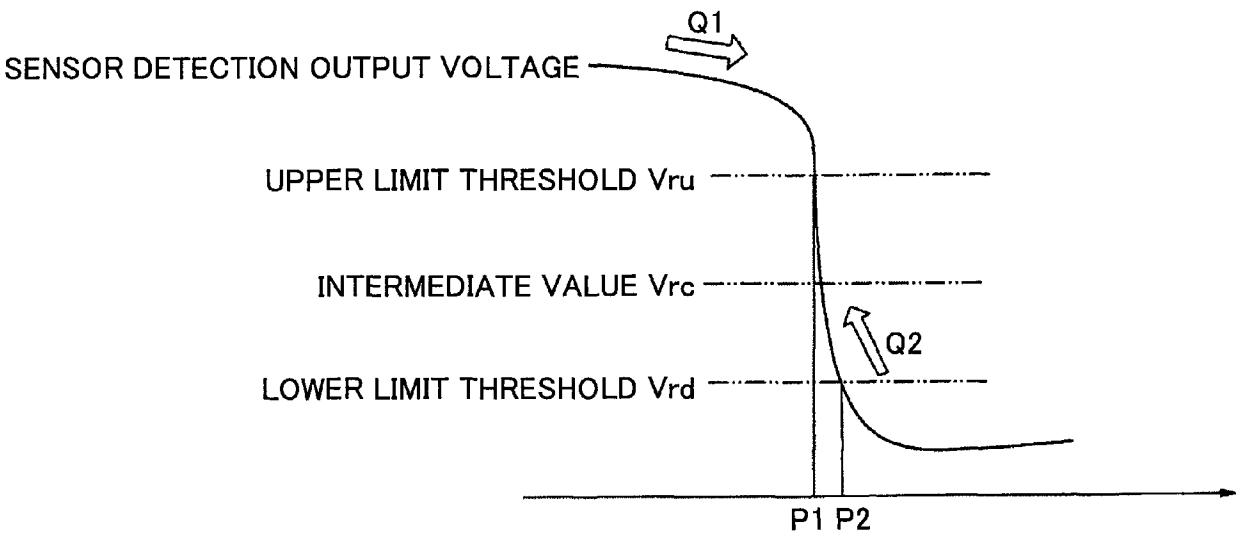

FIGS. 17A and 17B illustrate a second example. By scanning the same patterns 401*k*1, 400*k*2 as those of the first example with the pattern reading sensor 401, a sensor output voltage So as shown in FIG. 17A can be obtained. FIG. 17B is an enlarged view of the portion where the sensor output voltage So falls.

This portion where the sensor output voltage So falls is searched in a direction indicated by an arrow Q1 shown in FIG. 17B, and the point where the sensor output voltage So falls below (becomes less than or equal to) a lower limit threshold Vrd is stored as a point P2. Next, from the point P2, the sensor output voltage So is searched in a direction indicated by an arrow Q2, and the point where the sensor output voltage So exceeds an upper limit threshold Vru is stored as a point P1. Then, a regression line L1 is calculated from the output voltage So between the point P1 and the point P2. An obtained regression line formula is used to calculate an intersection point C1 of the regression line L1 and an intermediate value Vrc of the upper and lower thresholds. In the same manner, a regression line L2 is calculated for the stand up portion of the sensor output voltage So. An intersection point C2 of the regression line L2 and the intermediate value Vrc of the upper and lower thresholds is calculated. Based on the intermediate point of the intersection point C1 and the intersection point C2, a line center C12 is obtained by (intersection point C1+intersection point C2)/2.

Figure 18:
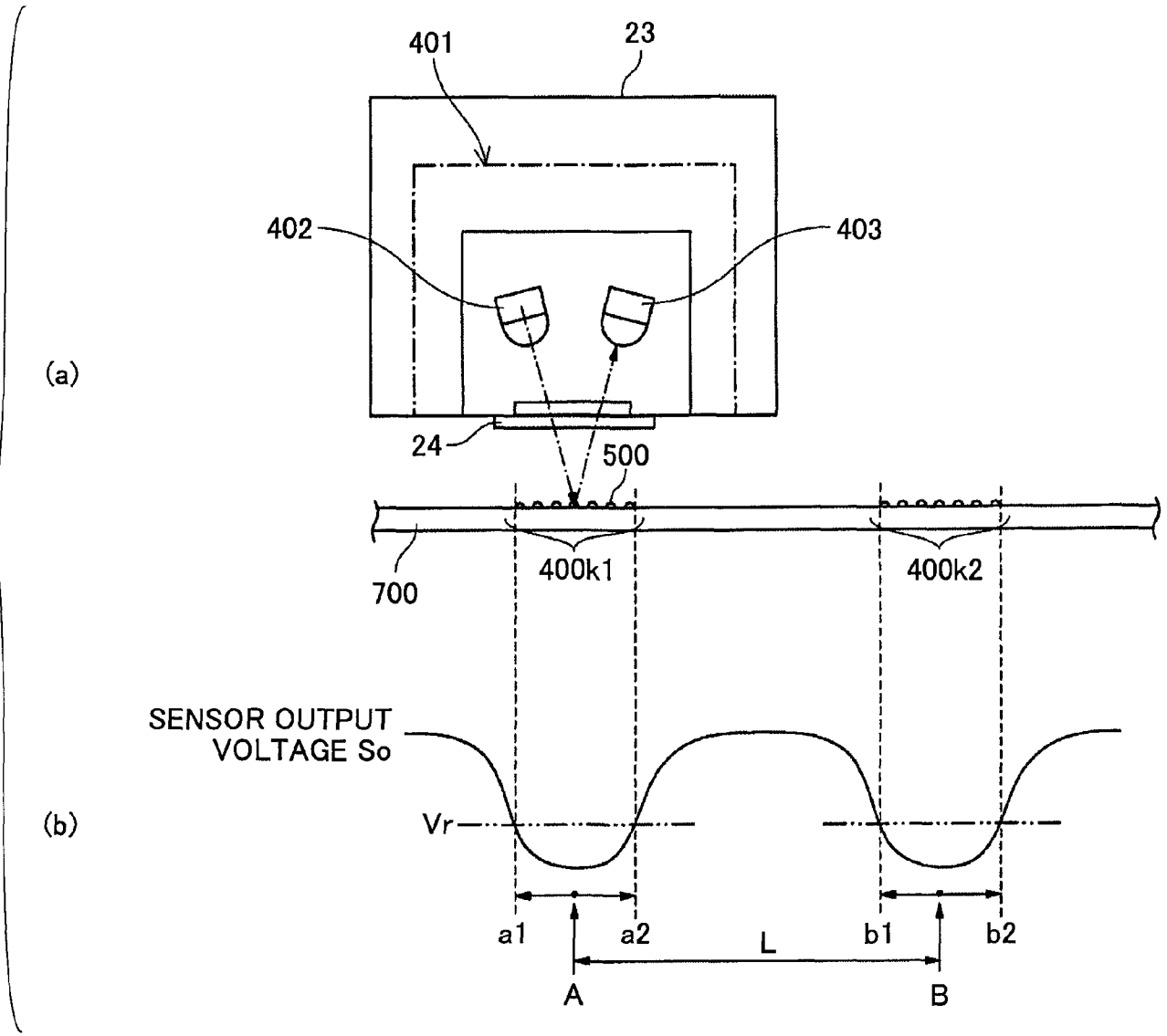
FIG. 18 illustrates a third example of a process for detecting the position of an adjustment pattern.

FIG. 18 illustrates a third example. As shown in FIG. 18(*a*), similar to the first example, on the water-repellent sheet member 700, the line-shaped pattern 400*k*1 is formed with the recording head 24*k*1, and the line-shaped pattern 400*k*2 is formed with the recording head 24*k*2. These are scanned with the pattern reading sensor 401 in the main scanning direction. Accordingly, a sensor output voltage So (photoelectric conversion output voltage) is obtained, as shown in FIG. 18(*b*).

With the above-described processing algorithm 526, a process is performed to remove harmonic noise with an IIR filter, and then the quality of the detected signals is evaluated (whether there are missing signals, unstable signals, or excessive signals), tilted portions near the threshold Vr are detected, and a regression curve is calculated. Furthermore, intersection points a1, a2, b1, and b2 of the regression curve and the threshold Vr are calculated (in a practical situation, the calculation is performed by a position counter, which position is configured with an ASIC: application-specific integrated circuit). Moreover, an intermediate point A of the intersection points a1 and a2, and an intermediate point B of the intersection points b1 and b2 are calculated, and a length L between the intermediate point A and the intermediate point B is calculated. Accordingly, an intermediate position between the pattern 400*k*1 and the pattern 400*k*2 is determined.

Then, the difference between the calculated length L and an ideal length between the recording head 24*k*1 and the recording head 24*k*2 is calculated by (ideal length between heads-L). This difference corresponds to the shift amount of an actually printed image. Therefore, based on this obtained shift amount, a correction value is calculated for correcting the timing of jetting liquid droplets from the recording heads 24*k*1, 24*k*2 (liquid droplet jetting timing). The correction value is set in the liquid droplet jetting control unit 502. Accordingly, the liquid droplet jetting control unit 502 drives the heads at the corrected liquid droplet jetting timings, and therefore positional shifts are reduced.

Next, examples of different shapes of landed ink drops forming the adjustment pattern 400 are described with reference to FIGS. 19 through 21B.

Figure 19:
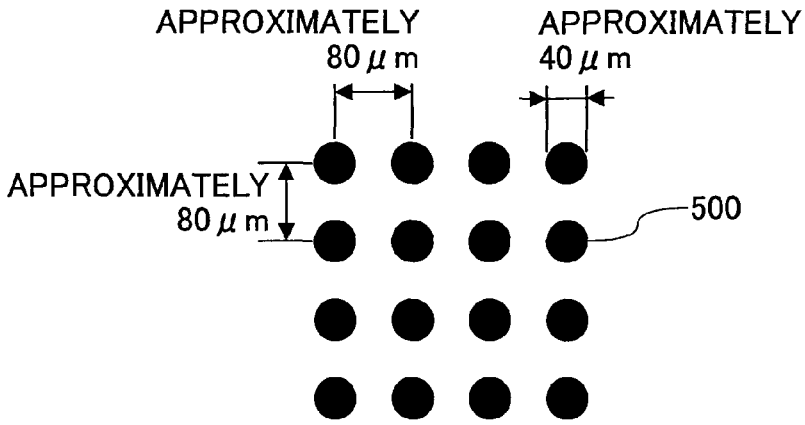
FIG. 19 illustrates a first example of shapes of liquid droplets that have landed to form an adjustment pattern.

FIG. 19 illustrates a first example in which plural liquid droplets 500 are arranged separately from each other in a lattice.

Figure 20A:
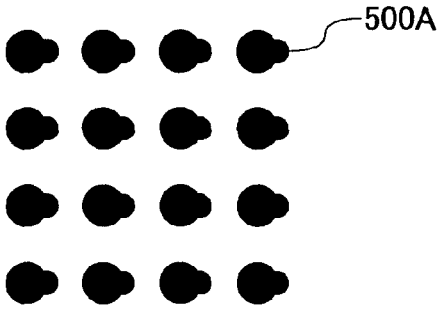
FIGS. 20A and 20B illustrate a second example of shapes of liquid droplets that have landed to form an adjustment pattern.
Figure 20B:
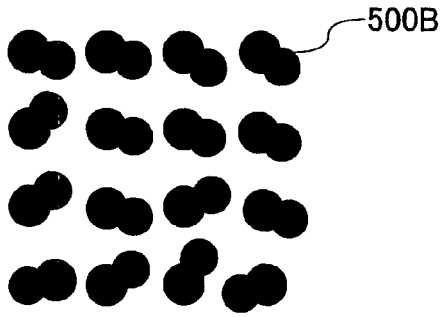

FIG. 20A and FIG. 20B illustrate two variations of a second example. In the variation shown in FIG. 20A, a large drop (for example, a main drop) and a small drop (for example, a satellite drop or a small drop) are combined together to form a single liquid droplet 500A having a lageniform shape. These liquid droplets 500A are arranged separately from each other in a lattice. In the variation shown in FIG. 20B, two liquid droplets having substantially the same size are combined together to form a single liquid droplet 500B. These liquid droplets 500B are arranged separately from each other in a lattice.

Figure 21A:
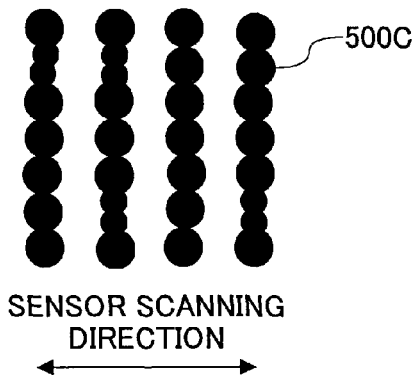
FIGS. 21A and 21B illustrate a third example of shapes of liquid droplets that have landed to form an adjustment pattern.
Figure 21B:
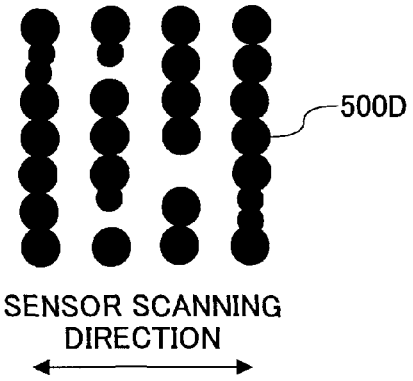

FIG. 21A and FIG. 21B illustrate two variations of a third example. In the modification shown in FIG. 21A, the liquid droplets are consecutively combined together in the direction perpendicular to a scanning direction of the pattern reading sensor 401, thus forming a single liquid droplet 500C shaped as a line. Plural line-shaped liquid droplets 500C are arranged in the sensor scanning direction. In the variation shown in FIG. 21B, liquid droplets 500D are shaped as irregularly broken lines. That is, there are partially missing portions in the lines of the variation shown in FIG. 21A (the lengths can be the same or different). Plural line-shaped liquid droplets 500D are arranged in the sensor scanning direction.

Figure 22A:
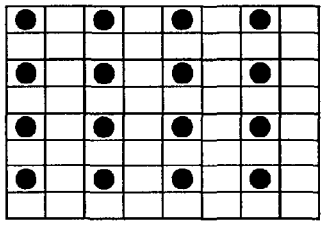
FIGS. 22A through 22C illustrate different examples of arrangement patterns of liquid droplets forming an adjustment pattern.

Next, configurations for improving the precision of landing position detection are described with reference to FIGS. 22A through 23.

First, it is assumed that the proportion of diffuse reflection light included in the reflection light from the adjustment pattern 400 is fixed. That is, the liquid droplets 500 are made to land in such a manner that the reflection light from the adjustment pattern 400 diffuses in a uniform manner, as in the ink droplets that have landed in the center part of FIG. 13. Accordingly, the sensor output voltage (detection potential) applied to the process algorithm will have high reproducibility, and therefore a highly precise adjustment pattern 400 (liquid droplet landing position) can be detected with high precision, and shifts in the liquid droplet landing position can be adjusted with high precision.

Figure 22B:
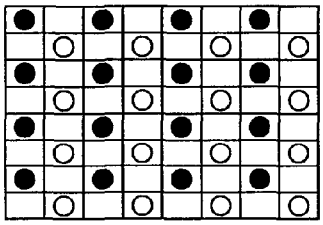
Figure 22C:
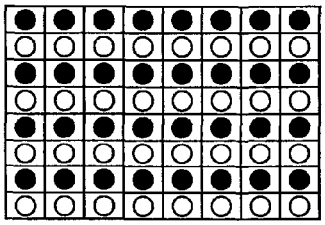

In order to make the reflection light from the adjustment pattern 400 diffuse in a uniform manner, the area that emits diffuse reflection light on the ink droplet surfaces is fixed. For example, as shown in FIG. 22A, the plural ink drops 500 included in the adjustment pattern are arranged separately from each other, provided in every other dot. In this case, adjacent ink drops will not be combined with each other, the ink drops 500 will adhere onto the water-repellent sheet member 700 in a regular manner, and the area that emits diffuse reflection light is fixed. As long as the ink drops are arranged separately from each other without being combined, the ink drops 500 can be arranged in a staggered manner as shown in FIG. 22B or the ink drops 500 can be arranged in all of the dots as shown in FIG. 22C.

Furthermore, as shown in FIG. 12, with the passage of time after liquid droplets land, the ink drops will dry and the extent to which the reflection light diffuses will change. Accordingly, by fixing the time from when the ink drop lands to when the pattern reading sensor 401 receives the specular reflection light, the detection potential can be made to have high reproducibility.

Moreover, as long as the reflection light diffuses in a uniform manner, each of the regularly arranged ink drops 500 can be formed with two combined liquid droplets (for example, a main drop and a satellite drop) as illustrated in FIGS. 20A and 20B.

Figure 23:
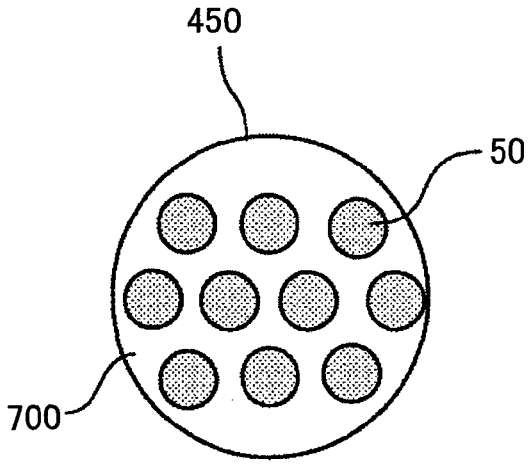
FIG. 23 is for describing the liquid droplet contact area within a detection range.

Furthermore, in order to make the reflection light diffuse in a uniform manner, for example, as shown in FIG. 23, the contact area of the ink drops 500 and the water-repellent sheet member 700 within a detection range (detection region) 450 is fixed. For example, the plural ink drops 500 included in the aforementioned adjustment pattern 400 are arranged separately from each other, in every other dot. By jetting the same amount ink to form each ink drop 500 and arranging the ink drops 500 separately from each other, it is possible to fix the contact area where the ink drops are adhering to the surface of the water-repellent sheet member 700. Also in this case, as long as the ink drops are arranged separately from each other without being combined, the ink drops 500 can be arranged in a staggered manner. It will help to fix the contact area by using pigment ink having a water-repellent relationship with the water-repellent sheet member 700.

Furthermore, a synergistic effect will be attained by fixing both the area that emits diffuse reflection light among the total area of the ink drops, and also the contact area of the ink drops on the water-repellent sheet member. As a result of this synergistic effect, the reflection light from the adjustment pattern will diffuse in an even more uniform manner, and the detection potential will have even higher reproducibility.

Figure 24:
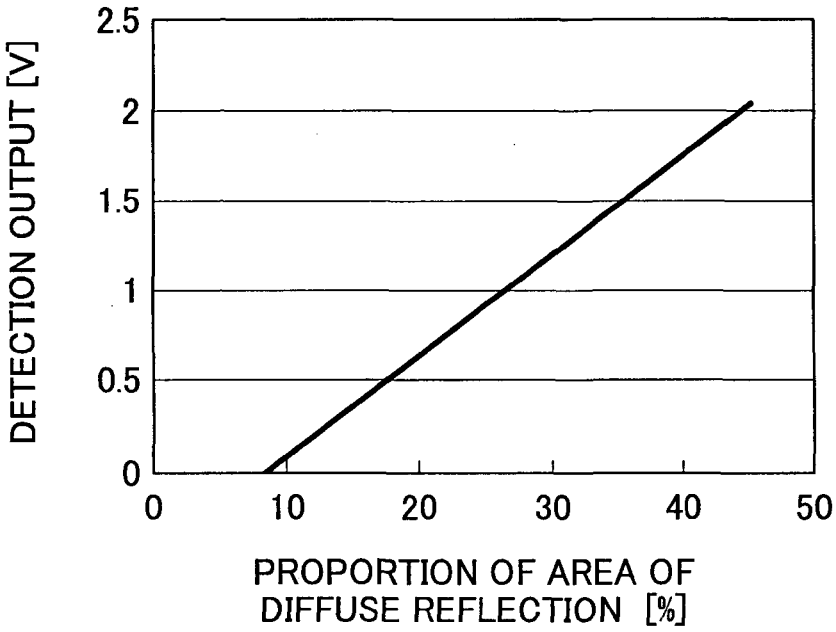
FIG. 24 illustrates the experimental results of the relationship between the proportion of the diffuse reflection area and the detection output expressed by an approximate line.

If the ink drops are not arranged close enough to each other, the detection output indicating whether the adjustment pattern 400 exists will not be large enough. This point needs to be taken into consideration. Specifically, an experiment was conducted to confirm the correlation between the area on the ink droplets where reflection light diffuses and the detection output amount. As shown in FIG. 24, it was found that this relationship can be expressed by an approximate line, and that a desired level of detection output can be attained if the reflection light diffuses on 10% or more of the area of the adjustment pattern.

Next, a description is given of the liquid droplets forming the adjustment pattern, from the perspective of diffuse reflection of the pattern.

Figure 25:
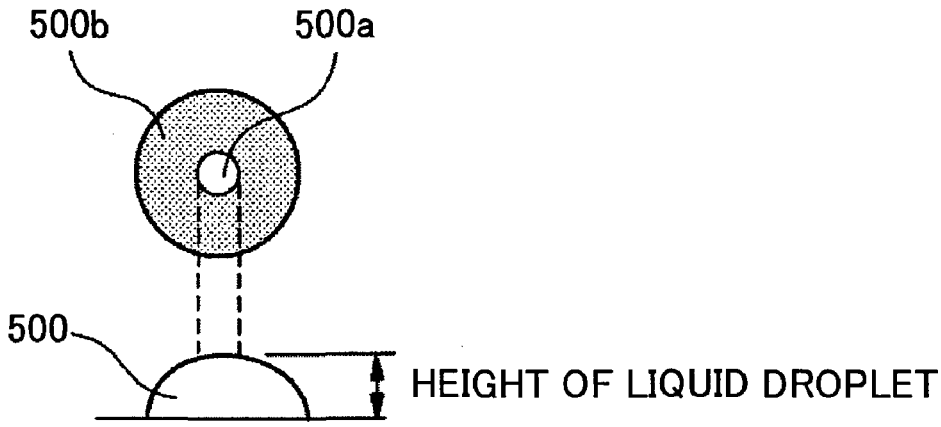
FIG. 25 is a schematic diagram of a liquid droplet for describing the pattern diffuse reflection rate.
Figure 26:
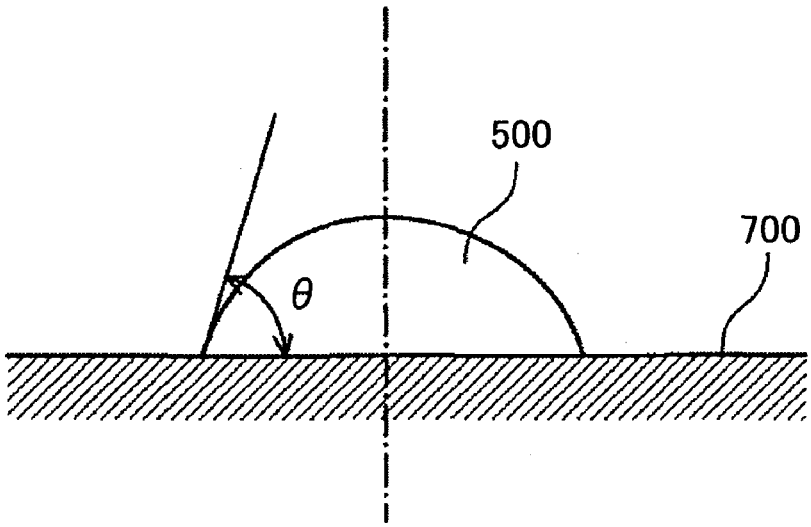
FIG. 26 is a diagram for describing the contact angle of a liquid droplet.

A pattern diffuse reflection rate refers to the proportion of a part in which diffuse reflection occurs (part where diffuse light is generated) within a detection range (detection region) detected by the pattern reading sensor 401. An example of a detection range is shown in FIG. 23 as described above. Specifically, the pattern diffuse reflection rate can be calculated as follows:

pattern diffuse reflection rate=total area of diffuse reflection/area of detection range If the detection range is fixed, the pattern diffuse reflection rate can be increased by increasing the area of diffuse reflection. The area of diffuse reflection is described as follows. As shown in FIG. 25, when the ink drop 500 adheres to the surface of the water-repellent sheet member 700, the ink drop 500 will have a hemispheric shape if the wettability is low (if the contact angle θ shown in FIG. 26 is large). In such a case, above the outer periphery of the ink drop 500, a specular reflection part 500*a* and a diffuse reflection part 500*b* will be formed with respect to light from a certain direction. By controlling the operation of jetting ink drops, this diffuse reflection part 500*b* (drop diffuse reflection rate) can be increased for each ink drop 500.

The drop diffuse reflection rate refers to the proportion of the diffuse reflection part with respect to the contact area of the ink drop with the water-repellent sheet member. This can be calculated as follows:

drop diffuse reflection rate=area of diffuse reflection part in one drop/contact area of one drop with water-repellent sheet member Specifically, among liquid droplets that can be used to form images, the adjustment pattern 400 is preferably formed with liquid droplets having maximum jetting amounts (drop volume). That is, the adjustment pattern 400 is to be formed by jetting liquid droplets in a print mode for jetting maximum drops. Accordingly, the height of the liquid droplet 500 shown in FIG. 25 can be increased, so that the drop diffuse reflection rate is increased.

Furthermore, the composition of ink may be different for each color (cyan, magenta, yellow, and black). Therefore, the shape of the liquid droplet 500 may be different for each color. Accordingly, the jetting amount (drop volume) of each liquid droplet is to be controlled according to the color of the liquid droplet to be jetted to increase the drop reflection rate.

As described above, the image forming apparatus is provided with the liquid droplet jetting unit (recording head) for jetting liquid droplets; water-repellent sheet members for receiving liquid droplets; a unit for forming an adjustment pattern including plural liquid droplets arranged separately from each other, which pattern is used for detecting landing positions of the liquid droplets; a reading unit including a light emitting unit for emitting light to be irradiated onto the adjustment pattern and a light receiving unit for receiving specular reflection light of the light irradiated onto the adjustment pattern; and a unit for correcting landing positions of the liquid droplets by calculating the landing position shift amount based on attenuation signals of the specular reflection light output from the reading unit. Therefore, the following effects can be achieved. That is, by controlling the liquid droplet jetting operation in such a manner as to maximize the pattern diffuse reflection rate of the liquid droplets included in the adjustment pattern, it is possible to increase the output sensitivity of the light receiving unit (sensor), and to improve the reading performance such as the shift amount detection performance and repetition precision.

In this case, by controlling the liquid droplet jetting unit in such a manner as to maximize the diffuse reflection area for each individual liquid droplet (drop diffuse reflection rate), the detection sensitivity and performance can be further improved. In order to maximize the diffuse reflection area, the liquid droplet jetting unit is preferably controlled as follows.

(1) Control the jetting amount of liquid droplets.
(2) Control the jetting amount of liquid droplets according to the color of the liquid droplets.
(3) Control the jetting operation in such a manner as to minimize the time difference between when the liquid droplets for forming the pattern are jetted and when the light emission/light reception is performed to read the pattern. Further, control the jetting operation so as to simultaneously jet the liquid droplets and perform the light emission/light reception with a single operation.
(4) Use a combination of materials with which the contact angle can be increased between the surface of the water-repellent sheet member and the liquid droplet.
(5) Make the shape of the liquid droplet in contact with the surface of the water-repellent sheet member circular or lageniform.
(6) Control the liquid droplet jetting operation in such a manner as to maximize the area of the liquid droplets, which are substantially separated from each other, within a range detectable by the light emitting unit and the light receiving unit. For example, the liquid droplets are preferably arranged so that the intervals between the liquid droplets are minimized.

Next, the operation of forming and detecting the adjustment pattern 400 is described. As described above, the shape of the ink drop changes with the passage of time after the ink drop adheres onto the water-repellent sheet member because the moisture of the liquid droplet evaporates. Accordingly, the amount of specular reflection light increases with the passage of time, starting immediately after the liquid droplet is formed. Thus, the output voltage of the pattern reading sensor 401 decreases with the passage of time.

For this reason, the adjustment pattern 400 is preferably detected by the pattern reading sensor 401 immediately after being formed, in order to accurately detect the landing positions of ink drops.

In one example, the printing speed of forming the adjustment pattern 400 is made to be the same as the speed of reading the adjustment pattern 400. As the adjustment pattern 400 is being printed, the position of the pattern is immediately detected. To perform such an operation, the pattern reading sensor 401 is to be provided on the upstream side of the carriage 23 in the scanning direction of printing the adjustment patter 400. However, such a configuration is only applicable to either one of the forward direction or the backward direction.

Accordingly, in another example, the printing speed of forming the adjustment pattern 400 is made to be different from the speed of reading the adjustment pattern 400. In both the forward direction and the backward direction, the adjustment pattern 400 is printed on the water-repellent sheet member 700 and is immediately detected without rotating the conveying belt 31. In this case, the pattern reading sensor 401 is located above the region where the adjustment pattern 400 is formed.

Figure 27:
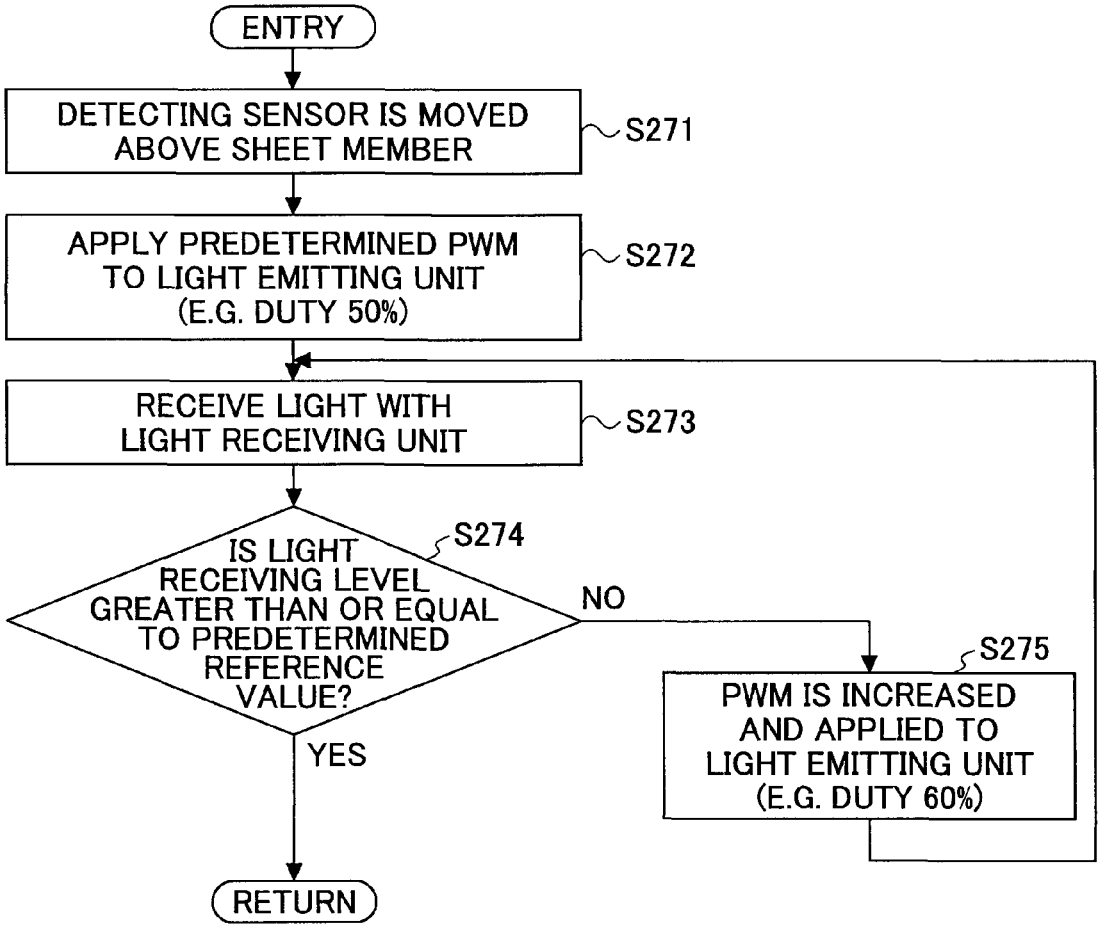
FIG. 27 is a flowchart for describing a control process for adjusting the light emitting amount of a reading sensor.

Next, with reference to FIG. 27, a description is given of a light emitting amount adjustment process according to an embodiment of the present invention, which is performed before the main control unit 310 corrects the shifts in the liquid droplet landing position.

First, the water-repellent sheet member 700 is fed. The sheet member detecting unit 330 (leading edge position detecting sensor) is moved to a position above the water-repellent sheet member 700 (step S271). The light emitting element 402 of the pattern reading sensor 401 is driven to emit light at a predetermined PWM value (for example, 50% duty) (step S272). The light receiving element 403 of the pattern reading sensor 401 receives light reflected from the water-repellent sheet member 700 (step S273). The main control unit 310 determines whether the light receiving level is greater than or equal to a predetermined reference value (a predetermined light receiving level) (step S274). If the light receiving level is not greater than or equal to the reference value (No in step S274), the PWM value is increased to increase the amount of light to be emitted from the light emitting element 402 of the pattern reading sensor 401 (step S275). Under such a condition, light is emitted once again from the light emitting element 402 (step S273) and the light receiving level is compared once again with the standard value (step S274). This operation is repeated.

Accordingly, it is possible to improve the precision in repetitive detection operations.

Figure 28:
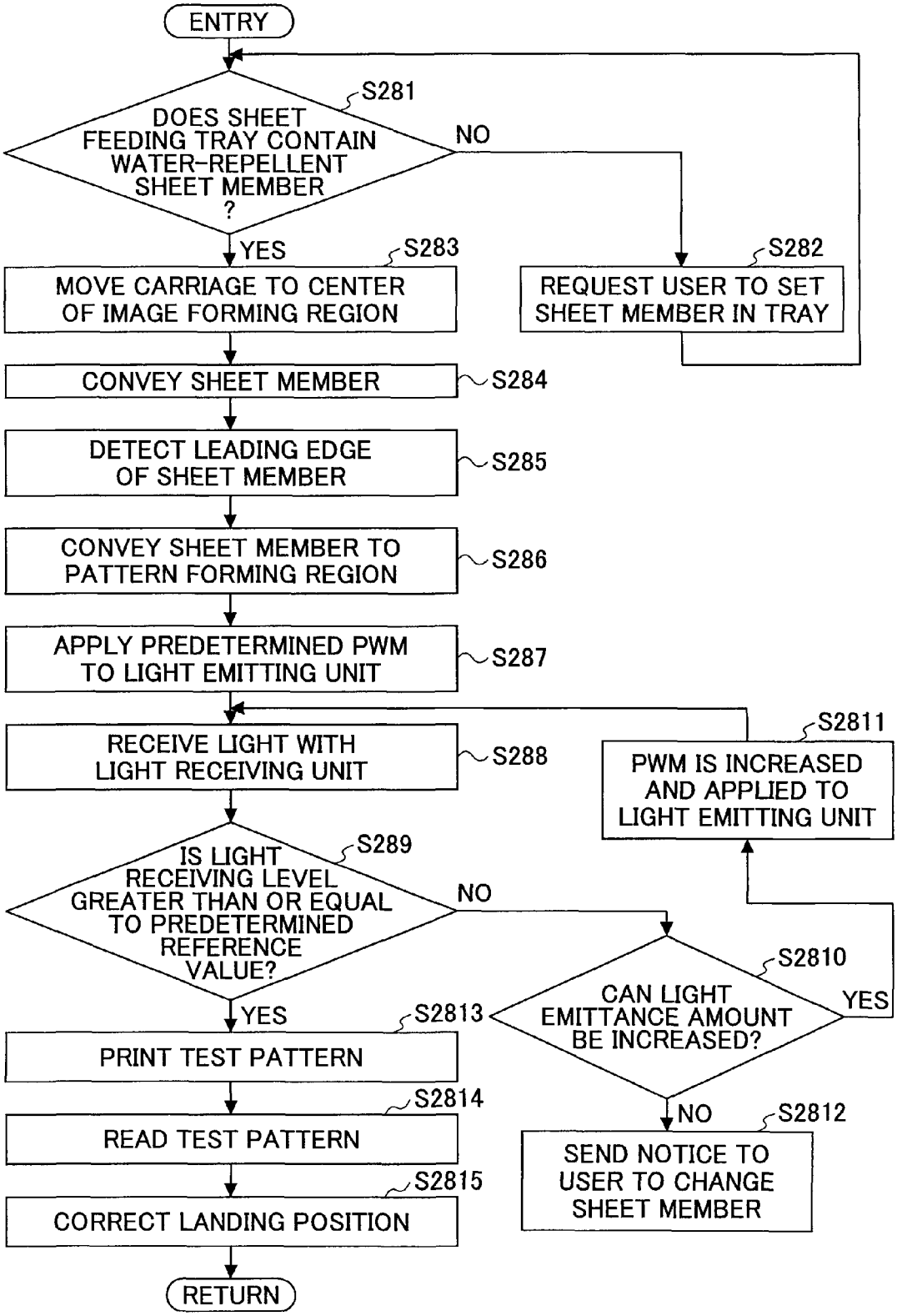
FIG. 28 is a flowchart of a process for detecting and adjusting liquid droplet landing positions.
Figure 29A:
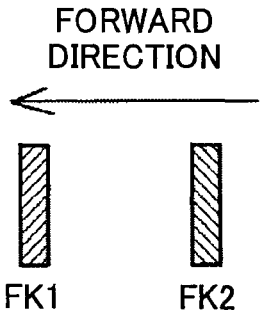
FIGS. 29A through 29D illustrate block patterns.
Figure 29C:
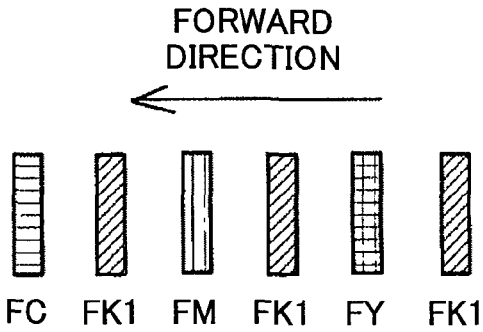
Figure 29B:
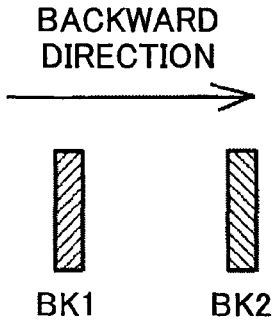
Figure 29D:
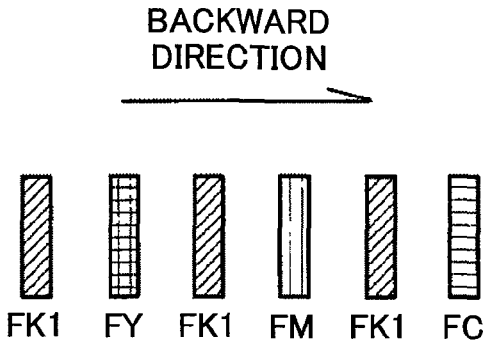

Next, with reference to FIG. 28, a description is given of a liquid droplet landing position shift correction process according to an embodiment of the present invention, which is performed by the main control unit 310.

First, when a liquid droplet landing position shift correction process operation is instructed with a not shown operations panel, the main control unit 310 determines whether the sheet feeding tray (or manual feeding tray) contains the water-repellent sheet member 700 (step S281). If there are no water-repellent sheet members 700 (No in step S281), the main control unit 310 requests the user to set the water-repellent sheet member 700 in the tray (step S282).

When the water-repellent sheet member 700 is set (Yes in step S281), the main control unit 310 moves the carriage 23 to the center of the image forming region in the main scanning direction (step S283), conveys the water-repellent sheet member 700 (step S284), detects the water-repellent sheet member 700 with the sheet member detecting unit 330 (leading edge position detecting sensor) (step S285), and then conveys the water-repellent sheet member 700 to the adjustment pattern forming region (step S286). Subsequently, as described with reference to FIG. 27, the light emitting element 402 of the pattern reading sensor 401 is driven to emit light at a predetermined PWM value (for example, 50% duty) (step S287). The light receiving element 403 of the pattern reading sensor 401 receives light reflected from the water-repellent sheet member 700 (step S288). The main control unit 310 determines whether the light receiving level is greater than or equal to a predetermined reference value (a predetermined light receiving level) (step S289). If the light receiving level is not greater than or equal to the reference value (No in step S289), the main control unit 310 determines whether it is possible to increase the amount of light to be emitted (step S2810). If the light emission amount can be increased (Yes in step S2810), the PWM value is increased to increase the amount of light to be emitted from the light emitting element 402 of the pattern reading sensor 401, light is emitted once again from the light emitting element 402 (step S2811), and the light receiving level is once again compared with the standard value (steps S288 and S289). If the light emission amount cannot be increased (No in step S2810), the main control unit 310 sends a notice to this effect the user to change (exchange) the water-repellent sheet member 700 (step S2812).

Subsequently, if a predetermined light receiving level can be attained (Yes in step S289), a predetermined adjustment pattern (test pattern) is formed on the water-repellent sheet member 700 (step S2813), the test pattern is read with the pattern reading sensor 401 (step S2814), the positional shift amount is calculated based on the read results, and the landing position correction is performed by changing the liquid droplet jetting timing according to the calculated positional shift amount (step S2815).

With reference to FIGS. 29A through 29D, a description is given of a block pattern (also referred to as basic pattern) for each minimum unit for detecting landing position shifts included in the adjustment pattern 400 according to an embodiment of the present invention.

In the above-described landing position shift correction method for this image forming apparatus, with the use of a recording head (color) that is to be a reference head, a line-shaped pattern is formed on the conveying belt, which pattern extends in a direction perpendicular to the movement direction of the conveying belt. Then, other recording heads (of other colors) are used to form similar line-shaped patterns with fixed intervals along the movement direction of the conveying belt. The distance between the reference head and another head is calculated (measured).

There are four types of block patterns (basic patterns) for each minimum unit, as follows. In the basic pattern shown in FIG. 29A, when the image formation is performed in the forward direction (first scan), a pattern FK1 formed by the recording head 24*k*1 is used as a reference for detecting the landing position shift of a pattern FK2 formed by the recording head 24*k*2. In the basic pattern shown in FIG. 29B, when the image formation is performed in the backward direction (second scan), a pattern BK1 formed by the recording head 24*k*1 is used as a reference for detecting the landing position shift of a pattern BK2 formed by the recording head 24*k*2. In the basic pattern shown in FIG. 29C, when the image formation is performed in the forward direction (third scan), each of the patterns FK1 formed by the recording head 24*k*1 is used as a reference for detecting the landing position shifts of patterns FC, FM, and FY of colors C, M, and Y formed by the recording heads 24*c*, 24*m*, and 24*y*, respectively. In the basic pattern shown in FIG. 29D, when the image formation is performed in the backward direction (fourth scan), each of the patterns FK1 formed by the recording head 24*k*1 is used as a reference for detecting the landing position shifts of patterns FC, FM, and FY of colors C, M, and Y formed by the recording heads 24*c*, 24*m*, and 24*y*, respectively. These block patterns can be combined to form an adjustment pattern for obtaining various detection results.

Figure 30:
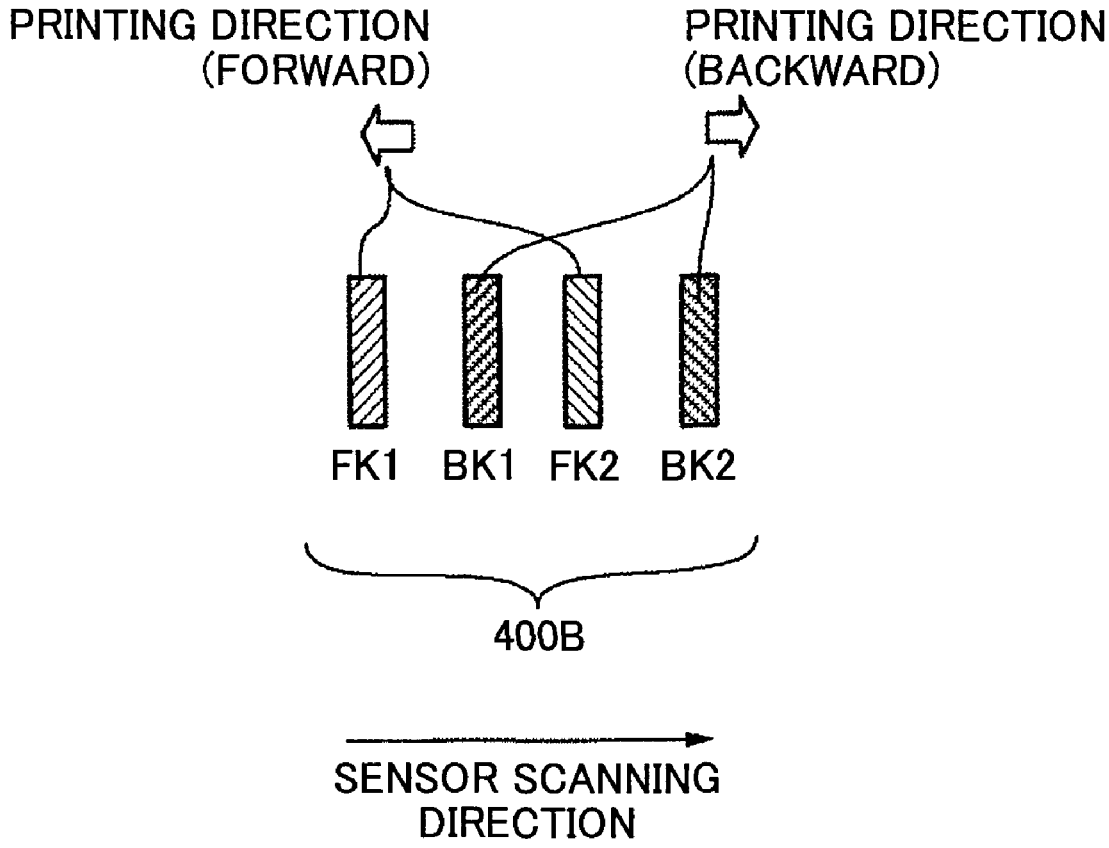
FIG. 30 illustrates a horizontal line shift adjustment pattern.
Figure 31A:
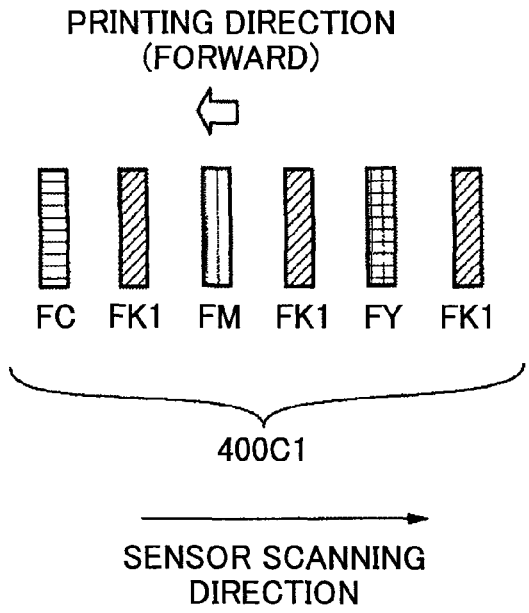
FIGS. 31A and 31B illustrate color shift adjustment patterns.
Figure 31B:
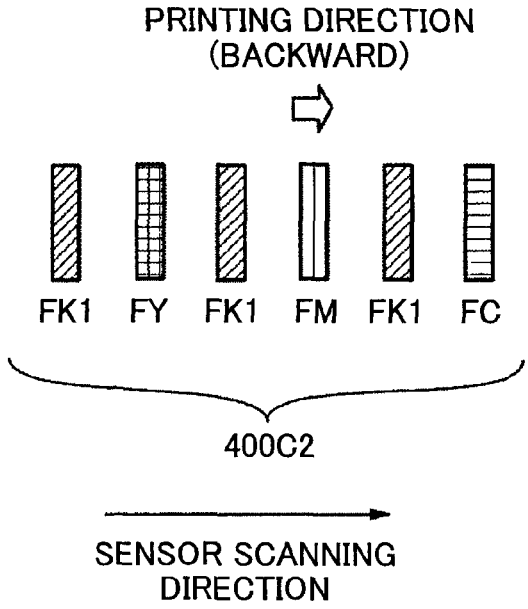

Next, with reference to FIGS. 30, 31A, and 31B, adjustment patterns including the above block patterns are described. One adjustment pattern is for detecting shifts in monochrome horizontal lines and another is for detecting color shifts.

In a horizontal line shift adjustment pattern 400B shown in FIG. 30, the position of the pattern FK1 in the reference direction (assumed to be forward direction) is used as a reference (the pattern FK1 is used as a reference pattern) for printing, at predetermined intervals, the pattern BK1 in the backward direction, the pattern FK2 in the forward direction, and the pattern BK2 in the backward direction (these are the patterns to be measured). Thus, based on the position information of each of the patterns FK1, BK1, FK2, and BK2, it is possible to detect the landing position shifts with respect to the pattern FK1 which is the reference pattern. The sensor scanning direction (reading direction) indicates a case where only one direction is read.

FIGS. 31A and 31B illustrate color shift adjustment patterns 400C1 and 400C2, respectively. In these patterns, the reference color is used as a reference (the patterns FK1 recorded by the recording head 24*k*1 are used as reference patterns) for printing patterns FY, FM, and FC of the respective colors at predetermined intervals (these are the patterns to be measured). The landing positions of patterns FK1 and FY, FK1 and FM, and FK1 and FC are detected to detect the landing positions of each color pattern with respect to the corresponding reference pattern FK1. The sensor scanning direction (reading direction) indicates a case where only one direction is read.

Figure 32:
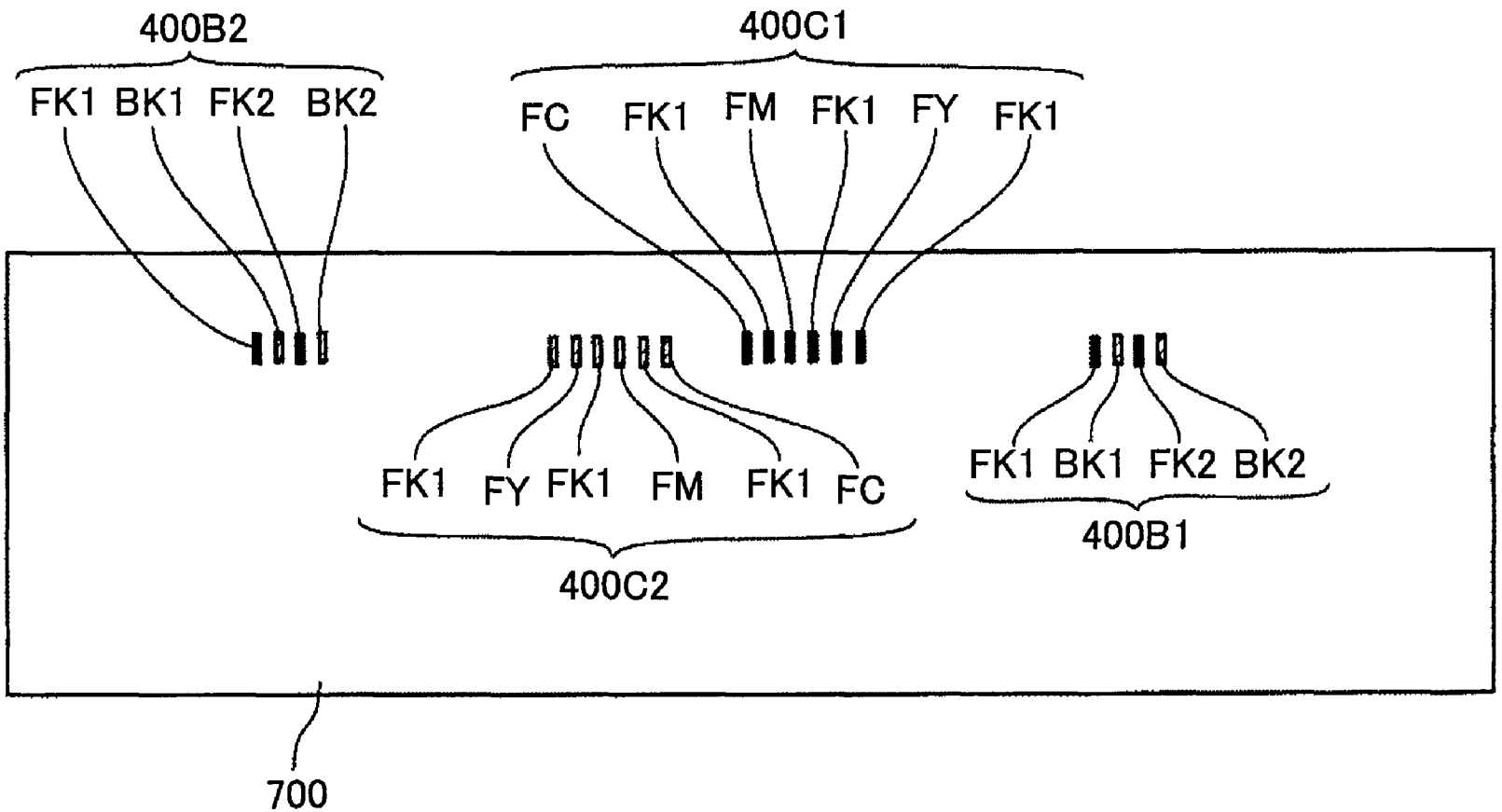
FIG. 32 illustrates an example of adjustment patterns.

Next, a specific example of an adjustment pattern is described with reference to FIG. 32.

As for the scanning direction of the carriage 23, as shown in FIG. 2, the forward direction is the direction from the back side of the apparatus toward the front side of the apparatus, and the backward direction is the direction from the front side of the apparatus toward the back side of the apparatus. Furthermore, the carriage 23 is provided with the recording heads 24*c*, 24*k*1, 24*k*2, 24*m*, and 24*y* in the stated order from the downstream side in the forward direction (front side of apparatus).

In this example, horizontal line positional shift adjustment patterns 400B1 and 400B2 are formed at edges of the water-repellent sheet member 700. The color shift adjustment patterns 400C1 and 400C2 are formed in the middle of the water-repellent sheet member 700. That is, in this example, plural block patterns are arranged within the width of the printing region in the direction perpendicular to the movement direction of the water-repellent sheet member 700.

Each time the horizontal line positional shift adjustment patterns 400B1, 400B2 and the color shift adjustment patterns 400C1, 400C2 are printed, they are read plural times by the pattern reading sensor 401. The reading can be performed plural times in one direction (same direction) or the reading can be performed plural times in both directions.

For example, the carriage 23 is moved in the forward direction to sequentially read and detect the positions of the patterns 400B1, 400C1, 400C2, and 400B2 with the pattern reading sensor 401. For example, in the horizontal line positional shift adjustment pattern 400B1, the pattern FK1 is assumed to be the reference pattern and the pattern BK1 is assumed to be the pattern to be measured, and the distance between these are calculated. Accordingly, it is possible to obtain the landing position shift amount between the forward direction and the backward direction for the recording head 24*k*1.

For example, in the horizontal line positional shift adjustment pattern 400B1, the pattern FK1 is assumed to be the reference pattern and the pattern BK2 is assumed to be the pattern to be measured, and the distance between these are calculated. Accordingly, it is possible to obtain the landing position shift amount with respect to the actual distance between the recording head 24*k*1 and the recording head 24*k*2.

Furthermore, in the color shift adjustment pattern 400C1, each of the patterns FK1 is assumed to be the reference pattern. The distance between the pattern FK1 and the pattern FY, the distance between the pattern FK1 and the pattern FM, and the distance between the pattern FK1 and the pattern FC are calculated. Accordingly, it is possible to obtain the landing position shift amounts with respect to the actual distances between the recording heads 24*k*1, 24*y*, 24*m*, and 24*c*.

In order to improve detection precision, plural patterns 400B1, 400B2, 400C1, and 400C2 are read/scanned, and average values are calculated.

Based on the calculated shift amount, the main control unit 310 controls (changes) the timings at which liquid droplets are jetted from the recording heads 24*k*1, 24*k*2, 24*y*, 24*m*, and 24*c*. Accordingly, the landing positions of jetted liquid droplets the can be made consistent for the recording heads 24*k*1, 24*k*2, 24*y*, 24*m*, and 24*c*.

As described above, a water-repellent sheet member has a water-repellent surface formed on at least one side. On this water-repellent surface, a landing position shift adjustment pattern is formed with plural liquid droplets that are separated from each other. Light is irradiated from a light emitting unit onto this adjustment pattern. Specular reflection light reflected from the adjustment pattern is received by the light receiving unit to detect the adjustment pattern. Based on results obtained by detecting the adjustment pattern, the landing position shifts of liquid droplets jetted from recording heads are corrected. Accordingly, with a simple structure, the landing positions of the liquid droplets can be detected with high precision and liquid droplet landing position shifts can be corrected with high precision.

Next, the water-repellent sheet member 700 according to an embodiment of the present invention is described with reference to FIGS. 33 and 34.

Figure 33:
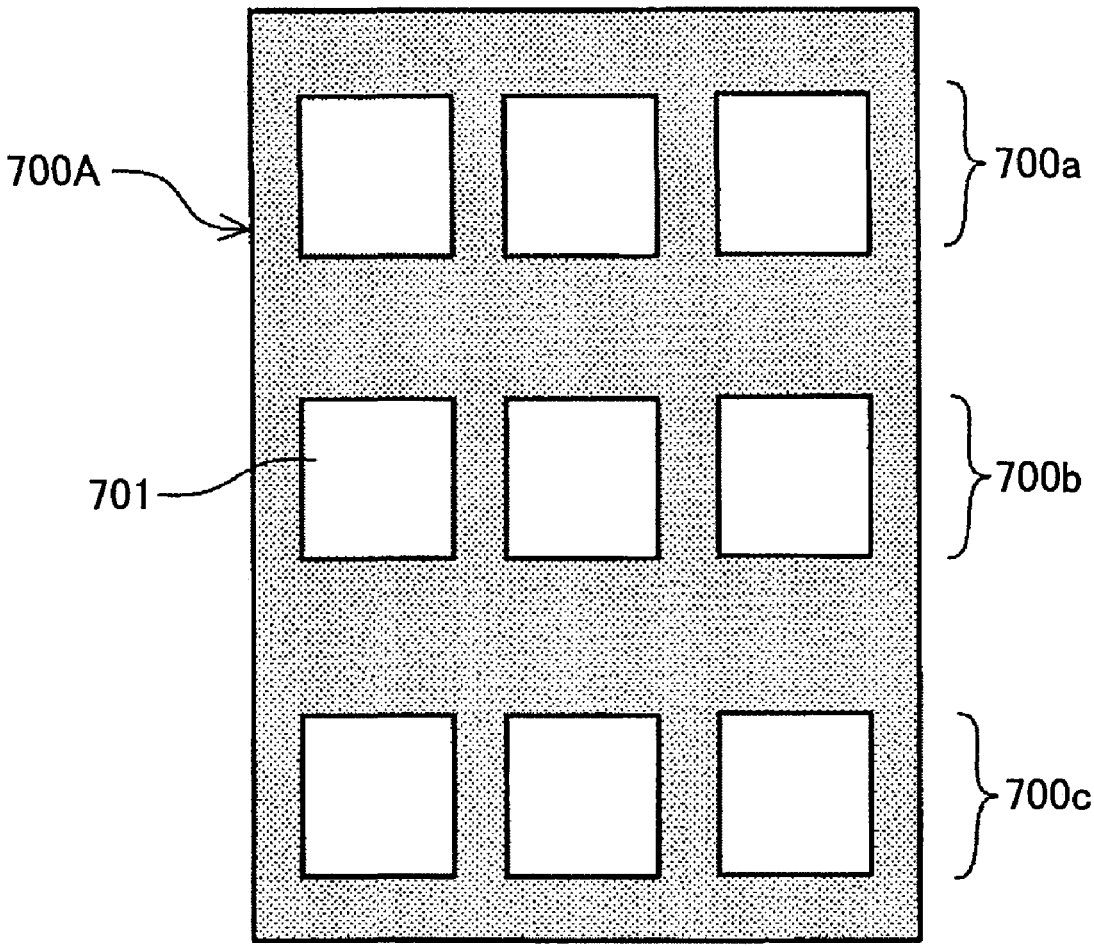
FIG. 33 illustrates an example of a water-repellent sheet member.

One side of a water-repellent sheet member 700A shown in FIG. 33 is partially coated with a water-repellent agent. These parts are referred to as water-repellent regions 701. In this example, a total of nine water-repellent regions 701 are formed. Specifically, the water-repellent sheet member 700A is divided into a top part 700*a*, a middle part 700*b*, and a bottom part 700*c*, in the stated order in the conveyance direction of the water-repellent sheet member 700A, and each of these parts includes three water-repellent regions 701.

Therefore, the adjustment patterns 400 are formed on this water-repellent sheet member 700A in the following manner. In a first landing position shift correction operation, the adjustment patterns 400 are formed in the water-repellent regions 701 included in the top part 700*a* of the water-repellent sheet member 700A. In a second landing position shift correction operation, the adjustment patterns 400 are formed in the water-repellent regions 701 included in the middle part 700*b* of the water-repellent sheet member 700A. In a third landing position shift correction operation, the adjustment patterns 400 are formed in the water-repellent regions 701 included in the bottom part 700*c* of the water-repellent sheet member 700A.

In this case, when the water-repellent sheet member 700A is set, a scanning operation is performed at a predetermined position to determine whether adjustment patterns 400 have already been formed, so that the adjustment patterns 400 can be formed in new regions (without patterns).

By printing the test pattern at separate positions in the above manner, i.e., the leading edge part, the middle part, and the trailing edge part of the water-repellent sheet member, the landing position shift correction can be performed in consideration of a floating portion in the water-repellent sheet member that is formed due to the resilience of the water-repellent sheet member. Furthermore, by providing plural patterns across the entire water-repellent sheet member and detecting them plural times, it is possible to improve reading performance such as repetition precision.

Figure 34:
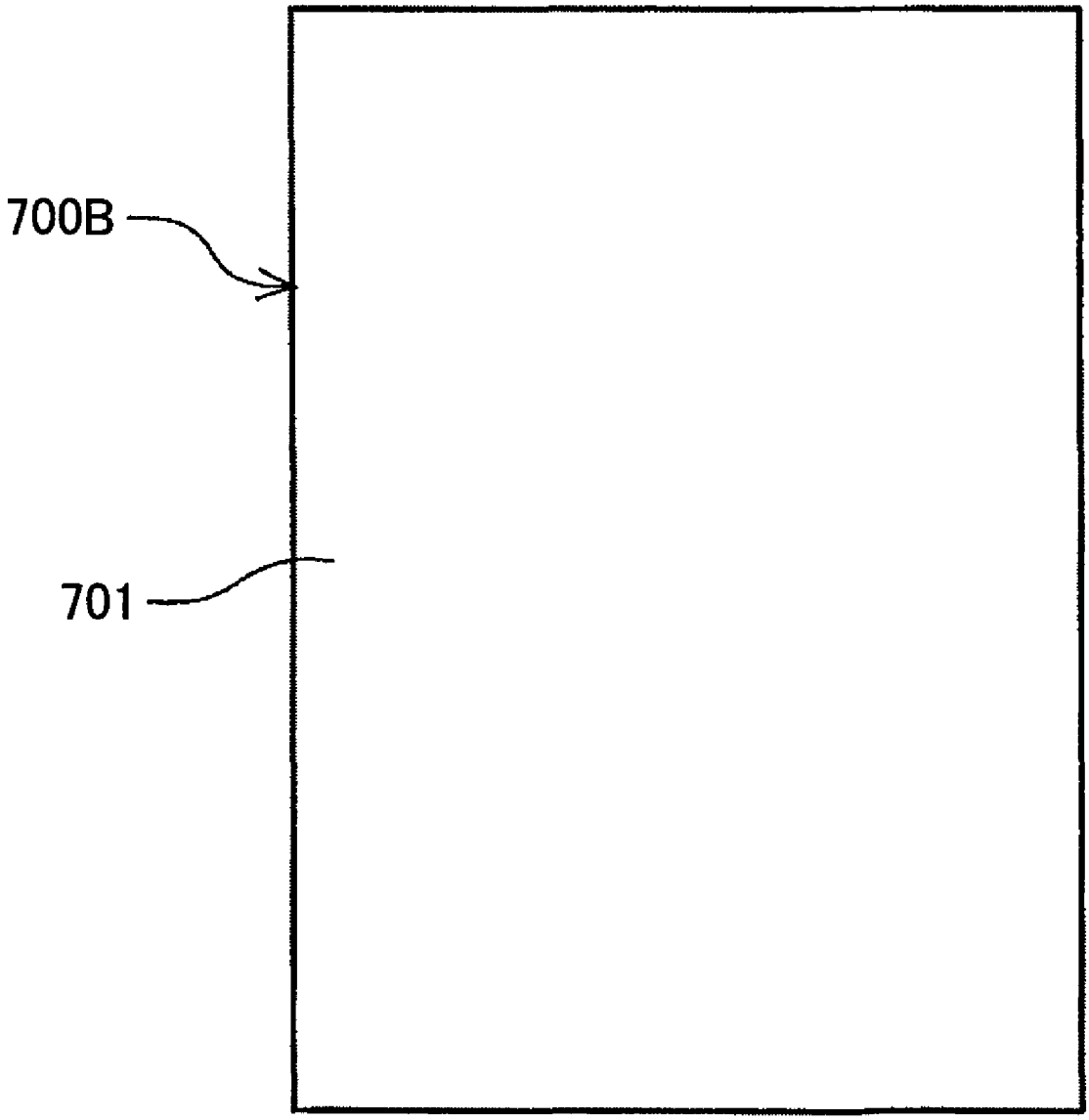
FIG. 34 illustrates another example of a water-repellent sheet member.

As a matter of course, as shown in FIG. 34, a water-repellent sheet member 700B is also applicable, which is entirely coated with a water-repellent agent so that the entire surface corresponds to the water-repellent region 701.

The water-repellent region 701 of the water-repellent sheet member 700 preferably provides a high specular reflection rate, a high degree of luster, and a high degree of smoothness on a recording target medium used for a typical image forming operation performed by the image forming apparatus, such as a plain paper sheet into which ink permeates.

The specular reflection rate refers to the proportion of the parts where specular reflection occurs with respect to a surface where liquid droplets have landed within the detection range 450 of the pattern reading sensor 401. This value is calculated as follows:

specular reflection rate=(total area of specular reflection parts/area of detection range)

By using a water-repellent sheet member having a high specular reflection rate, the diffuse reflection rate on the surface of the water-repellent sheet member decreases, and therefore the sensitivity increases.

Figure 35B:
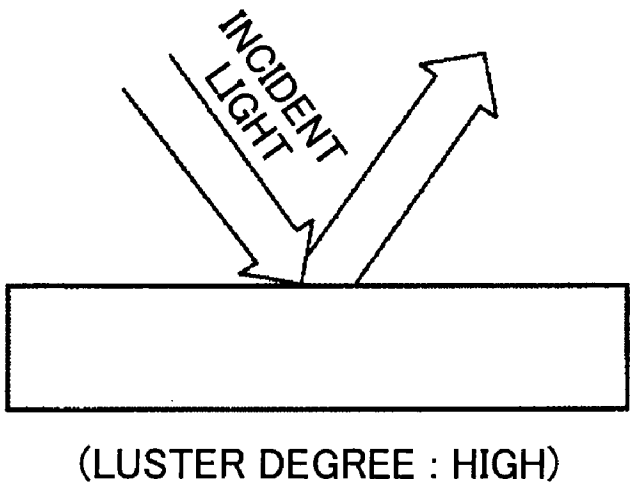
FIGS. 35A and 35B illustrate the relationship between the luster degree of a water-repellent sheet member and the specular reflection light.
Figure 35A:
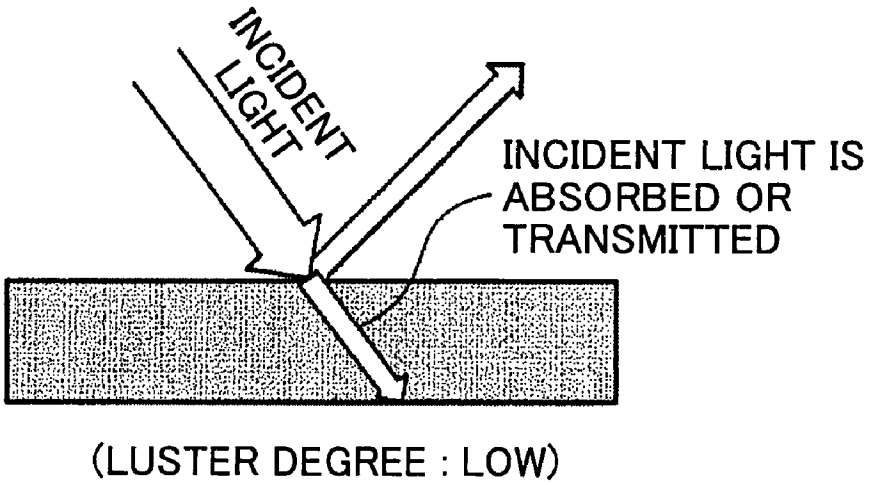
Figure 36B:
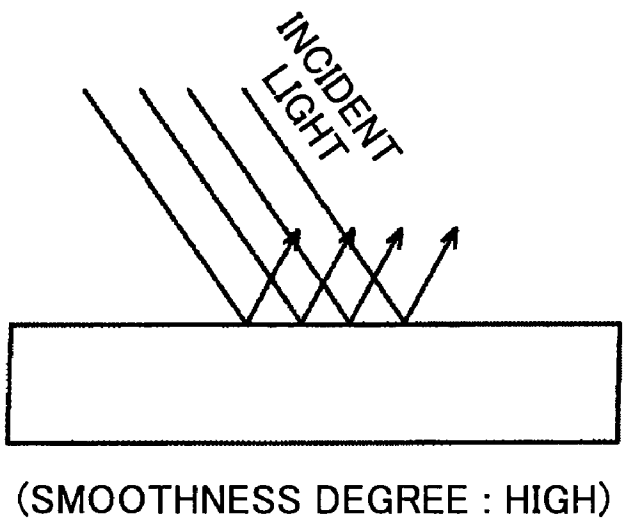
FIGS. 36A and 36B illustrate the relationship between the smoothness degree of a water-repellent sheet member and the specular reflection light.
Figure 36A:
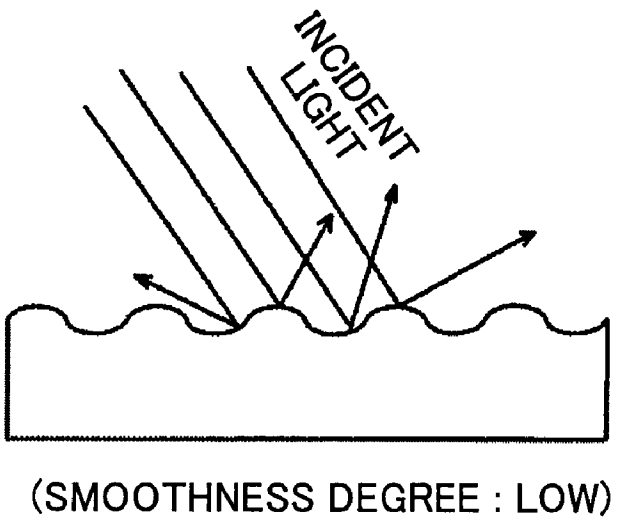

Furthermore, the specular reflection rate will increase as the degree of luster and the degree of smoothness increase on the surface of the water-repellent sheet member. Specifically, as shown in FIG. 35A, if the luster degree is low, part of the incident light is absorbed or transmitted in the sheet member, and therefore the specular reflection light will decrease. Conversely, as shown in FIG. 35B, if the luster degree is high the entire incident light is reflected from the sheet member, and therefore the specular reflection light will increase. Furthermore, as shown in FIG. 36A, if the smoothness degree is low the incident light is diffused, and therefore the specular reflection light will decrease. Conversely, as shown in FIG. 36B, if the smoothness degree is high the entire incident light is reflected, and therefore the specular reflection light will increase.

Figure 37:
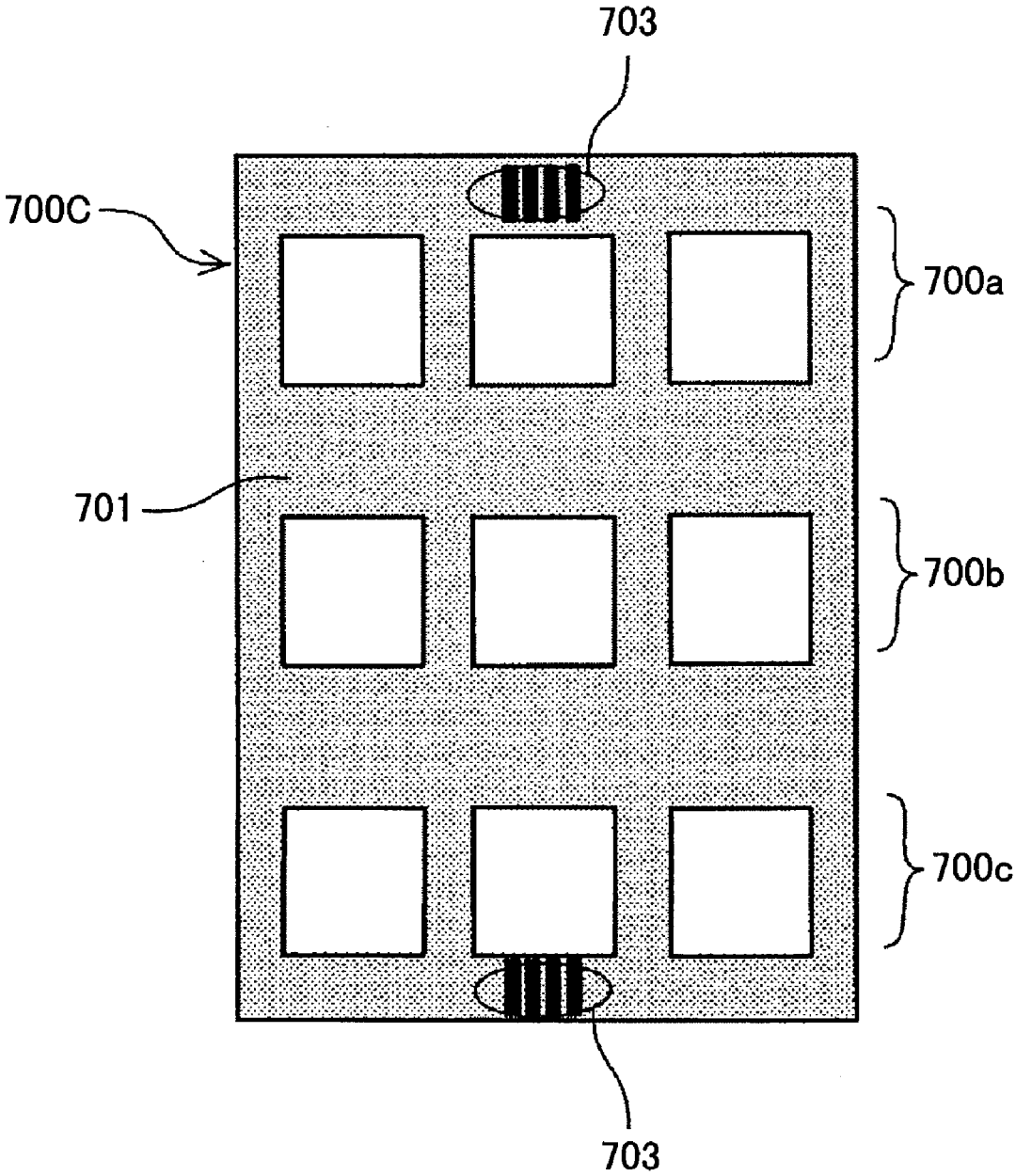
FIG. 37 illustrates yet another example of a water-repellent sheet member.

Next, another example of the water-repellent sheet member 700 according to an embodiment of the present invention is described with reference to FIG. 37.

A water-repellent sheet member 700C is formed by providing marks 703 onto the water-repellent sheet member 700A described with reference to FIG. 35. These marks 703 are identification units for indicating that this is a water-repellent sheet member. The marks 703 are provided on the leading edge and the trailing edge of the water-repellent sheet member 700A in the conveyance direction, thereby forming the water-repellent sheet member 700C. The marks 703 can be two-dimensional patterns such as bar codes, three dimensional patterns with recessions/projections, or magnetic patterns.

Figure 38:
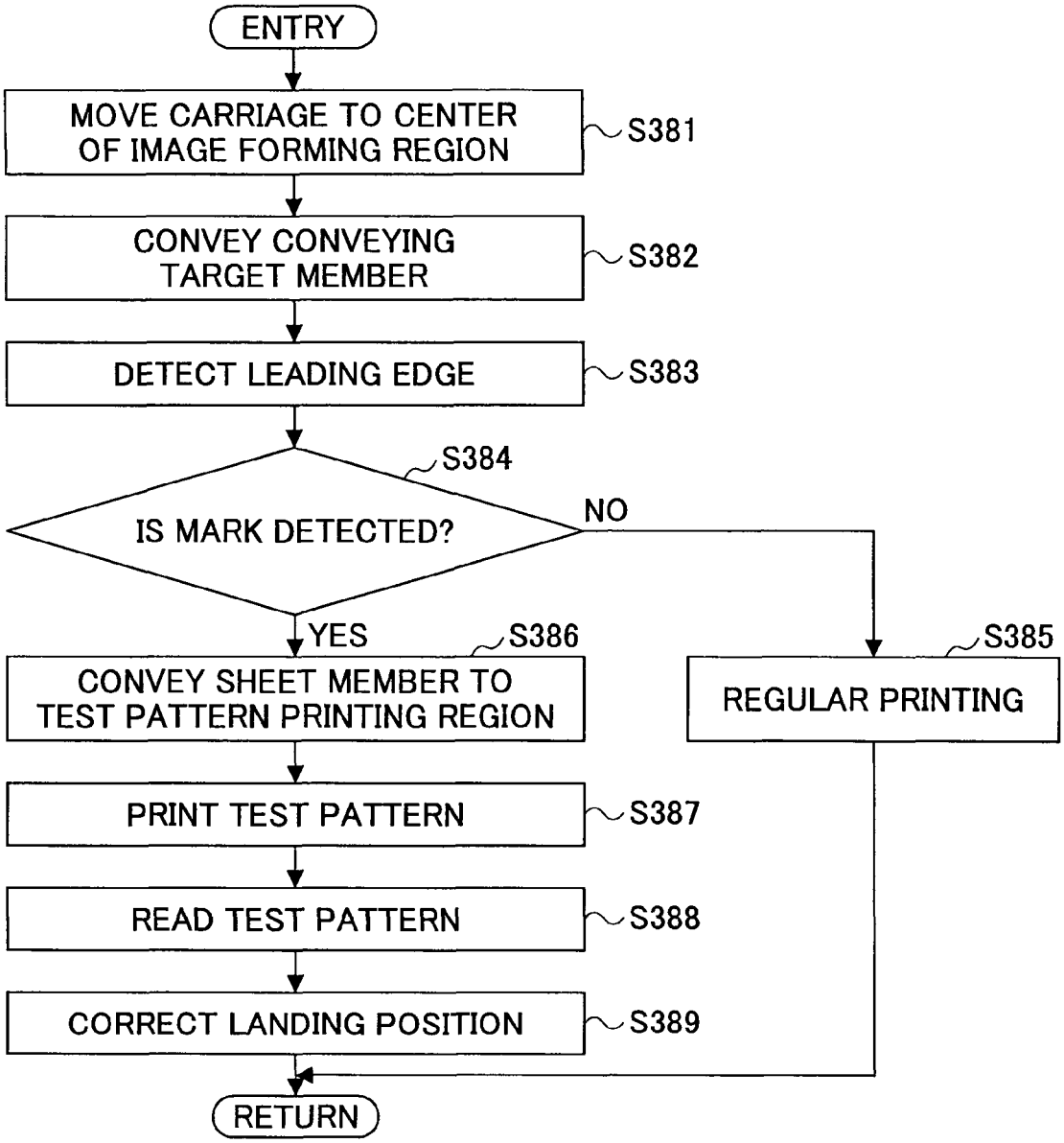
FIG. 38 is a flowchart of a process for detecting and adjusting liquid droplet landing positions with the use of the water-repellent sheet member shown in FIG. 37.

Next, a description is given of a landing position correction process performed with the use of the water-repellent sheet member 700C, with reference to FIG. 38.

First, to detect the leading edge of a conveying target member that is being conveyed, the carriage 23 is moved to the center of the image forming region in the main scanning direction (step S381). The conveying target member is conveyed (step S382). The sheet member detecting unit 330 detects the leading edge of the conveying target member (step S383). It is determined whether the mark 703 is detected (step S384). If the mark 703 is not detected (No in step S384), the conveying target member is determined to be a regular recording target medium and a regular printing operation will be performed (step S385).

Conversely, if the mark 703 is detected at the time of detecting the leading edge (Yes in step S384), the conveying target member is determined to be the water-repellent sheet member 700C. Therefore, the water-repellent sheet member 700C is conveyed to the test pattern forming region (step S386), and then the test pattern 400 is formed on the water-repellent sheet member 700C (step S387). The pattern reading sensor 401 reads the test pattern 400 (step S388) and the landing position shift amount is calculated. The landing positional correction is performed (step S389) by correcting the liquid droplet jetting timing based on the calculated landing position shift amount.

As described above, at the time of detecting the leading edge of a conveying target member being conveyed, it is determined whether the conveying target member is a water-repellent sheet member. If it is a water-repellent sheet member, the landing position correction operation of forming a test pattern is started automatically. Accordingly, the operation for performing the landing position correction can be simplified.

According to one embodiment of the present invention, an image forming apparatus for forming an image on a recording target medium that is being conveyed includes a recording head configured to jet liquid droplets, a pattern forming unit configured to form, on a water-repellent surface of a water-repellent sheet member, an adjustment pattern used for correcting shifts in landing positions of the liquid droplets, wherein the adjustment pattern includes plural liquid droplets that are separated from each other, and the water-repellent surface having a water-repellent property is formed on at least a part of a surface of the water-repellent sheet member, a reading unit including a light emitting unit configured to irradiate light onto the adjustment pattern and a light receiving unit configured to receive specular reflection light from the adjustment pattern, and a landing position correction unit configured to correct, based on a reading result obtained by the reading unit, the shifts in the landing positions of the liquid droplets that are jetted from the recording head.

Additionally, the image forming apparatus is preferably configured to determine whether a conveying target medium that is being conveyed is the water-repellent sheet member. In the event that the conveying target medium is determined to be the water-repellent sheet member, operations for correcting the shifts in the landing positions are started. In this case, the image forming apparatus is preferably configured to detect an identification unit provided on a leading edge of the water-repellent sheet member, which identification unit is configured to indicate that a member to which it is provided is the water-repellent sheet member.

Additionally, the image forming apparatus preferably has a configuration in which the water-repellent sheet member includes an upstream region, a midstream region, and a downstream region in the stated order in a conveyance direction of the water-repellent sheet member, and the adjustment pattern is formed on at least one of the upstream region, the midstream region, and the downstream region. In this case, the image forming apparatus preferably has a configuration in which before the adjustment pattern is formed, the light emitting unit irradiates the light onto the water-repellent sheet member and the light receiving unit receives the specular reflection light to obtain a light reception result, and in the event that the light reception result is less than or equal to a predetermined reference value, a light emission amount of the light emitting unit is increased.

According to one embodiment of the present invention, a method of correcting landing positions of liquid droplets jetted from a recording head includes a forming step of forming, on a water-repellent surface of a water-repellent sheet member, an adjustment pattern used for correcting shifts in the landing positions of the liquid droplets, wherein the adjustment pattern includes plural liquid droplets that are separated from each other, and the water-repellent surface having a water-repellent property is formed on at least a part of a surface of the water-repellent sheet member, a detecting step of detecting the adjustment pattern by irradiating light onto the adjustment pattern from a light emitting unit and receiving specular reflection light from the adjustment pattern with a light receiving unit, and a correcting step of correcting, based on a detection result obtained by detecting the adjustment pattern at the detecting step, the shifts in the landing positions of the liquid droplets that are jetted from the recording head.

According to one embodiment of the present invention, a water-repellent sheet member used for correcting landing positions of liquid droplets includes, at its leading edge, an identification unit configured to indicate that a member to which it is provided is the water-repellent sheet member. At least one of a specular reflection rate, a degree of luster, and a degree of smoothness of the water-repellent sheet member according to one embodiment of the present invention is higher than that of a plain paper sheet into which liquid permeates.

In the image forming apparatus and the landing position shift correction method according to an embodiment of the present invention, on a water-repellent surface of a water-repellent sheet member, an adjustment pattern used for correcting shifts in the landing positions of the liquid droplets is formed. The adjustment pattern includes plural liquid droplets that are separated from each other. The water-repellent surface having a water-repellent property is formed on at least a part of a surface of the water-repellent sheet member. The adjustment pattern is detected by irradiating light onto the adjustment pattern from a light emitting unit and receiving specular reflection light from the adjustment pattern with a light receiving unit. Therefore, with a simple structure, liquid droplet landing positions can be detected with high precision, and liquid droplet landing position shifts can be corrected with high precision The sheet member according to an embodiment of the present invention is provided with an identification unit configured to indicate that a member to which it is provided is the water-repellent sheet member. Therefore, operations for correcting the shifts in the landing positions can be automatically started. Furthermore, at least one of a specular reflection rate, a degree of luster, and a degree of smoothness of the water-repellent sheet member is higher than that of a recording target medium. Therefore, the precision in detecting the adjustment pattern can be improved.

The present invention is not limited to the specifically disclosed embodiment, and variations and modifications may be made without departing from the scope of the present invention.

The present application is based on Japanese Priority Patent Application No. 2007-069676, filed on Mar. 17, 2007, the entire contents of which are hereby incorporated by reference.

What is claimed is:

1. A method of correcting landing positions of liquid droplets jetted from a recording head, comprising:

a forming step of forming, on a water-repellent surface of a water-repellent sheet member, one or more adjustment patterns for correcting shifts in the landing positions of the liquid droplets, wherein the one or more adjustment patterns comprise plural liquid droplets that are separated from each other while maintaining a hemispheric shape without permeating into the water-repellent sheet member, and the water-repellent surface having a water-repellent property is formed on at least a part of a surface of the water-repellent sheet member;

a detecting step of detecting the one or more adjustment patterns by irradiating light onto the one or more adjustment patterns from a light emitting unit and receiving specular reflection light from the one or more adjustment patterns with a light receiving unit; and a correcting step of correcting, based on a detection result obtained by detecting the one or more adjustment patterns at the detecting step, the shifts in the landing positions of the liquid droplets that are jetted from the recording head, wherein each of the one or more adjustment patterns includes an adhering region and includes a separating region, the adhering region is occupied by the plural liquid droplets landing on the water-repellent surface, the separating region in each of the one or more adjustment patterns separates the plural liquid droplets from each other in said each of the one or more adjustment patterns formed on the water-repellent surface, and the separating region separating the plural landed liquid droplets from each other has an area smaller than an area of the adhering region occupied by the plural landed liquid droplets such that the plural liquid droplets are separated from each other and are close to each other in each of the one or more adjustment patterns and an amount of specular reflection light reflecting from the one or more adjustment patterns is reduced as compared to that of specular reflection light reflecting from other portions of the water-repellent surface.

2. The method according to claim 1, further comprising:

determining whether a conveying target medium that is being conveyed is the water-repellent sheet member, and in the event that the conveying target medium is determined to be the water-repellent sheet member, operations for correcting the shifts in the landing positions are started.

3. The method according to claim 1, further comprising:

detecting an identification unit provided on a leading edge of the water-repellent sheet member, and configured to indicate that a member to which the identification unit is provided is the water-repellent sheet member.

4. The method according to claim 1, wherein:

the water-repellent sheet member comprises an upstream region, a midstream region, and a downstream region in the stated order in a conveyance direction of the water-repellent sheet member; and the one or more adjustment patterns are formed on at least one of the upstream region, the midstream region, and the downstream region.

5. The method according to claim 1, further comprising:

before the one or more adjustment patterns are formed, irradiating light onto the water-repellent sheet member and receiving specular reflection light to obtain a light reception result; and in an event that the light reception result is less than or equal to a predetermined reference value, increasing a light emission amount of the light emitting unit.

6. The method of claim 1, wherein:

the water-repellent sheet member comprises an identification unit provided on a leading edge of the water-repellent sheet member, and configured to indicate that a member to which the identification unit is provided is the water-repellent sheet member.

7. The method of claim 1, wherein:

at least one of a specular reflection rate, a degree of luster, and a degree of smoothness of the water-repellent sheet member is higher than that of a plain paper sheet into which liquid permeates.

8. The method according to claim 1, wherein specular reflection light diffuses on 10% or more of the area of the one or more adjustment patterns.

9. The method according to claim 1, wherein for each of the plural liquid droplets, an area of the adjustment pattern formed by the liquid droplet is substantially the same as an area of the adjustment pattern formed by each of the other liquid droplets.

10. The method according to claim 1, wherein for each of the plural liquid droplets, a contact area between the liquid droplet and the water-repellent surface is substantially the same as a contact area between each of the other liquid droplets and the water-repellent surface.

* * * * *